US005624526A

United States Patent [19]

Perecman et al.

[11] Patent Number: 5,624,526

[45] Date of Patent: Apr. 29, 1997

[54] CONTINUOUS TAPE SUPPLY SYSTEM INCLUDING A TAPE SPLICING MECHANISM FOR USE WITH BOX TAPING MACHINES

[75] Inventors: Jack L. Perecman, Golden Valley; Lloyd S. Vasilakes, Stillwater; Daniel D. Baker, St. Paul; Van E. Jensen, Jr., Stillwater, all of Minn.

[73] Assignee: Minnesota Mining and Manufacturing, St. Paul, Minn.

[21] Appl. No.: 323,917

[22] Filed: Oct. 17, 1994

[51] Int. Cl.[6] ..... B65H 21/00

[52] U.S. Cl. ..... 156/361; 156/159; 156/502; 156/504; 242/551; 242/555

[58] Field of Search ..... 156/157, 159, 156/502, 504, 507, 361; 242/551, 552, 553, 555, 555.5

[56] References Cited

U.S. PATENT DOCUMENTS

| | | | |
|---|---|---|---|
| 3,053,787 | 5/1962 | Ota et al. . | |
| 3,549,458 | 12/1970 | Osta | 156/157 X |
| 3,580,757 | 5/1971 | Niepmann | 156/504 X |
| 3,654,035 | 4/1972 | Takimoto | 156/505 |
| 3,783,064 | 1/1974 | Okubo et al. . | |
| 4,113,197 | 9/1978 | Harrington et al. | 242/58.1 |
| 4,161,249 | 7/1979 | Dashow | 206/459 |
| 4,172,564 | 10/1979 | Romagnoli . | |
| 4,177,960 | 12/1979 | Nakagawa | 156/504 X |
| 4,264,401 | 4/1981 | Ganz | 156/504 |
| 4,415,127 | 11/1983 | Seragnoli | 242/553 |
| 4,772,350 | 9/1988 | Gamberini | 156/366 |
| 4,848,691 | 7/1989 | Muto et al. | 242/58.1 |
| 4,906,319 | 3/1990 | Fiorani . | |
| 5,033,688 | 7/1991 | Georgitsis et al. | 242/58.1 |
| 5,064,488 | 11/1991 | Dickey | 156/159 |
| 5,145,108 | 9/1992 | Pinckney et al. | 229/117.26 |
| 5,292,397 | 3/1994 | Lorenz et al. | 156/351 |
| 5,316,230 | 5/1994 | Focke et al. | 242/58.1 |
| 5,318,646 | 6/1994 | Cardini et al. | 156/157 |
| 5,323,586 | 6/1994 | Lissoni et al. | 53/136.4 |

FOREIGN PATENT DOCUMENTS

| | | |
|---|---|---|
| 8901547.9 | 5/1989 | Germany . |
| 57-098449 | 6/1982 | Japan . |
| 558109347 | 6/1983 | Japan . |
| 62-21656 | 1/1987 | Japan . |
| WO94/27869 | 12/1994 | WIPO . |

OTHER PUBLICATIONS

Brochure entitled *Scotch™ Brand T–66 Heat–Shrink Container Bander*, 3M and COM–TAL Machine & Engineering Inc. (Document No. 34–7004–7139–3), St. Paul, Minnesota, published 1987.

*Primary Examiner*—Mark A. Osele

*Attorney, Agent, or Firm*—Gary L. Griswold; Walter N. Krin; Charles D. Levine

[57] ABSTRACT

A continuous tape supply apparatus is provided which includes plural tape sources from which tape can be supplied to the tape applicator machine, a tension control means for providing the tape from the continuous tape supply apparatus at a substantially even tension under an indexing demand, and a splicing mechanism which is simpler in design and operation and which reliably causes a changeover of tape from one source to another. Once one source is depleted, the apparatus automatically switches to the second source, after which, a new supply can be substituted for the depleted supply and the apparatus made ready for the next subsequent changeover. The splicing mechanism includes a tape guide path through the splicing mechanism, a staging means comprising an applicator element which is movably disposed on the support between a staging position with the applicator element spaced from the tape guide path and a splice position with the applicator element moved within the tape guide path to change the tape guide path, and control means for causing the applicator element to move between its staging position to its splice position and for effecting a proper splice. The present invention is also directed to the combination of a continuous tape supply apparatus with a box tape applying machine.

31 Claims, 14 Drawing Sheets

CONTINUOUS TAPE SUPPLY SYSTEM INCLUDING A TAPE SPLICING MECHANISM FOR USE WITH BOX TAPING MACHINES

TECHNICAL FIELD

The present invention relates to the supply of adhesive tape from a continuous tape supply system for use with box sealing equipment. More specifically, the present invention includes a splicing mechanism to provide an uninterrupted supply of adhesive tape under the intermittent demand of a box sealing machine.

BACKGROUND OF THE INVENTION

In the supplying of any type of web materials from finite length supplies such as in roll form, including papers, films, woven and non-woven fabrics, adhesive tapes or the like, to be converted or otherwise applied to another material in a production line setting, it is desirable to minimize production line downtime caused by changing from one supply roll to another. One way of minimizing downtime is to use larger capacity rolls. A way of eliminating downtime is to provide for a changeover without interrupting the continuous material supply.

Under such continuous demand situations, it is known to incorporate a splicing mechanism into the web material supply to effect a roll changeover from a depleted roll to a new roll while the demand continues; that is, without stopping the supply of web material to the conversion or application systems. Typically, a new supply roll will be loaded onto the splicing mechanism in a ready position so that upon depletion of the current supply roll (or upon the expectation of such event), a leading edge of the new roll will be relatively moved to adhere or be otherwise connected to the remaining web material of the depleted roll. Upon such connection, the new roll will provide the currently demanded supply, and yet another roll can be readied for the next changeover.

Splicing mechanisms suitable for such use can be classified as either of the type that splices the new web material to the currently demanded web material while it is in motion, hereinafter referred to as an "on the fly" splicing mechanism, or of the type that splices the new web to the demanded web while it is temporarily stopped, hereinafter referred to as a "zero speed" splicing mechanism.

On the fly mechanisms may bring the web material of the new roll up to the demand speed before splicing or may let the demanded web material pick up the new web material from a lower speed or a stationary position. Zero speed splicing mechanisms must provide for a temporary supply of web material downstream from the splicing mechanism through which the demanded web material runs so that the web material can be temporarily stopped within the splicing mechanism during the splice. The capacity of the temporary supply must be sufficient to provide for the continuous demand for the time period over which the splice takes place. Usually, such capacity is provided by an accumulator comprising a loop or series of loops, hereinafter referred to as a festoon, which can be decreased in size during the continued demand while the web material is stopped at the splicing mechanism. The size of the festoon is then gradually increased to full capacity after the splice is completed. An obvious advantage of the on the fly splicing mechanisms is that they do not require the provision of a festoon after the splice mechanism. However, with the on the fly mechanisms, it is essential that the splice be precisely controlled so as to reliably effect such a connection of a new web to a moving web.

Examples of known apparatuses for splicing a web to another web, and in particular from a replacement web to a moving web are disclosed in U.S. Pat. Nos. 4,172,564 to Romagnoli, 4,264,401 to Ganz, 4,848,691 to Muto et al., 5,033,688 to Georgitsis et al., and 5,064,488 to Dickey. Each of these, however, deal with the situation of splicing one web to a moving web under a continuous and constant demand for the web material.

Under a continuous demand situation, the tension within the web remains substantially constant over the use of the entire roll by virtue of the even demand. Thus, splicing can be effectively controlled. To the contrary, an intermittent demand of the web material from the supply roll, which is common to box sealing machines, causes the tension within the web to fluctuate. Thus, in addition to supplying the web material, the tension thereof should be controlled to provide a substantially even tension throughout each demand cycle to minimize web feeding problems and failures.

Moreover, when dealing with the supplying of adhesive tape from a supply roll to a tape applicator machine, the stripping tension, that is the tensile force that is required to pull the adhesive tape from the roll, is very often significantly higher than the desired tension of the tape as it is supplied to the applicator machine. Thus, it may also be desirable to perform a reduction in the tape tension after it is stripped from its roll and before it is fed to the applicator machine. In the case of an intermittent demand type tape applicator machine, both tension reduction and tension evening may be necessary. Thus, any attempted splicing must also be accomplished within these difficult to control tension requirements.

Tape applicator machines are used in many ways for applying continuous lengths of tape or discrete lengths of tape to a variety of objects that are moved relative to the tape applicator. Of such tape applicator machines, one specific type is box sealing machines, also known as case sealers, which apply a length of tape to a box or carton to seal the box by taping the top flaps together.

Such box sealing machines may apply a length of tape in a configuration known as a C-clip in which a portion of the tape is applied to a front vertical portion of the box, over the top to seal the top flaps together, and then down a portion of the rear vertical wall. Otherwise L-clips of tape are sometimes provided at either the front or rear edges of the box or both, or a length of tape is adhered only to the top surface to connect the flaps. In any case, these machines have in common that the tape is demanded intermittently. In other words, tape is demanded from its supply as a length of tape is applied to one of such boxes or cartons by a tape applicator, and then the tape demand is stopped for a moment until the next box is positioned relative to the tape applicator for the next application. Moreover, typical intermittent tape demand of a box sealing machine, hereinafter referred to as indexing demand, can be characterized generally as a square wave representing an immediate demand upon the start of application of tape to a box up to the level (rate) of demand that is then substantially constant during the application of the tape length to the box until demand is ceased immediately upon the cutting of the length of tape from its supply roll.

Such intermittent applications may occur indefinitely as the boxes or cartons are fed along a continuous packaging line. However, such applicator machines have in the past been provided with only a limited supply of such adhesive tape. Thus, at some regular interval, the packaging line must be stopped so that a new roll of tape can be loaded into the applicator machine. Moreover, with the increasingly high demands for such packaging lines, which demand as much as about 200 feet of tape per minute (61 meters per minute), the interval may be too short requiring even more down time of the packaging line.

One attempt at minimizing the down time of production packaging lines, particularly those which run at relatively high speeds, is the designing and making of larger rolls of tapes. Moreover, specially wound tape rolls have been developed which provide as much as six times the amount of tape found in a typical tape roll. Such specially wound tape rolls are available from Minnesota Mining and Manufacturing Company of St. Paul, Minn. under the trademark Opta-pak. Although these rolls effectively minimize down time of a packaging line, they still must, by the virtue of the fact that they are a definite length, require some down time of the production line in order to change to a new roll.

The intermittent demand of such box sealing machines and similar applicators require that the tape tension be effectively controlled during the intermittent demand for smooth unwinding of the tape from the roll. Moreover, in many cases, a relatively high tension in the order of 3.5 lbs is necessary to strip the tape from its roll. On the other hand, the application of the tape to the objects should preferably be done at a relatively low tension of below 1 pound. Thus, it is important to effectively strip the tape from the roll at the required high tension while applying the tape to the objects at the relatively low tension and doing so smoothly under the indexing demand, described above, so as to minimize tape jams, failures or damage to boxes or cartons.

A continuous tape supply system has been developed for supplying an uninterrupted supply of tape to such an intermittent demand tape applicator machine and which accommodates the aforementioned tension requirements and is disclosed in co-pending U.S. patent application Ser. No. 08/067,240, filed May 26, 1993, to Rossini et al. The continuous supply apparatus of the Rossini case includes plural tape sources, a splicing station for splicing the tape from at least one of the tape sources to another of the tape sources, a means for causing the splice, and a tension control means for providing the tape from the continuous tape supply apparatus at a substantially consistent tension under an indexing demand. Although the Rossini et al. apparatus provides the continuous tape supply while taking into account the tension requirements of an intermittent demand situation, the combination of tension control and splicing mechanism thereof is relatively complex.

Other apparatuses have been developed for application of a discrete length of a web material, such as a deadening strip, to a portion of the continuous length of adhesive tape supplied in roll form and as thereafter applied on intermittent demand. Such devices have been used to provide tabs or handle portions, or the like to the length of tape as applied to a box or carton. Examples of tape handle producing and applying apparatuses are described in U.S. Pat. Nos. 4,906,319 to Fiorani and 5,145,108 to Pinckney et al. Moreover, an example of a device for providing tabs to the adhesive tape to facilitate removal of the tape from boxes is described in commonly owned U.S. patent application Ser. No. 08/002,194. None of these devices, however, provide a changeover operation from one roll to another. Such changeover operation is a critical part of a continuous tape supply system which requires that a plurality of tape rolls must be accommodated and controlled under the above-noted tensioning requirements.

SUMMARY OF THE PRESENT INVENTION

According to the present invention, a continuous tape supply apparatus is provided that overcomes the shortcomings of the prior art and which supplies adhesive tape at a substantially even tension for use by a tape applicator machine having an indexing demand. Moreover, the continuous tape supply apparatus includes plural tape sources from which tape can be supplied to the tape applicator machine, a tension control means for providing the tape from the continuous tape supply apparatus at a substantially even tension under an indexing demand, and a splicing mechanism which is simpler in design and operation and which reliably causes a changeover of tape from one source to another. Once one source is depleted, the apparatus automatically switches to the second source, after which, a new supply can be substituted for the depleted supply and the apparatus made ready for the next subsequent changeover.

In one aspect of the present invention, a continuous tape supply apparatus for supplying adhesive tape to a tape applicator machine is provided that includes a support, a first tape source station, a second tape source station, and a splicing mechanism for splicing tape from the second tape source station to tape from the first tape source station so as to change the supply of tape from the first tape supply source to the second tape supply source. The splicing mechanism comprises a guide means for defining a tape guide path through the splicing mechanism to be supplied from the continuous tape supply apparatus to the tape applicator machine, a staging means comprising an applicator element which is movably disposed on the support between a staging position with the applicator element spaced from the tape guide path and a splice position with the applicator element moved within the tape guide path to change the tape guide path, and control means for causing the applicator element to move from its staging position to its splice position upon the occurrence of a determined event and for moving the applicator element from its splice position back to its staging position.

In another aspect, the present invention relates to a continuous tape supply apparatus for supplying adhesive tape to a tape applicator machine comprising a support, a first tape source station, a second tape source station, and a splicing mechanism provided on the support for splicing tape from the second tape source station to tape from the first tape source station so as to change the supply of tape from the first tape supply source to the second tape supply source. The splicing mechanism comprising guide means for defining a tape guide path through the splicing mechanism to be supplied from the continuous tape supply apparatus to the tape applicator machine, a staging means comprising an applicator element which is movably disposed on the support between a staging position with the applicator element spaced from the tape guide path and a splice position with the applicator element moved toward the tape guide path, and control means for causing the applicator element to move from its staging position to its splice position upon the occurrence of a determined event and for moving the applicator element from its splice position back to its staging position after a predetermined length of tape is demanded from the continuous tape supply apparatus.

The present invention is also directed to the combination of a continuous tape supply apparatus with a box tape applying machine.

The above and other features and advantages of the subject invention and the manner of achieving them will become more apparent from the following detailed description and the appended claims, with reference to the attached drawing showing preferable embodiments of the present invention.

BRIEF DESCRIPTION OF THE DRAWINGS

FIG. 8 illustrates the continuous tape supply apparatus with tape demanded from the machine right side roll and passing through the splicing mechanism while a new roll of tape on the machine left side is staged for splicing to the first tape when depleted or otherwise signalled;

FIG. 9 is a view of the continuous tape supply apparatus with the splicing mechanism activated immediately after the occurrence of a splice is signalled with the tape from the new roll brought against the tape of the old roll;

FIG. 10 is a view of the continuous tape supply apparatus after the splicing mechanism has been activated and wherein the tape from the old roll of tape is severed and the tape demand begins from the new tape roll;

FIG. 11 is a view of the continuous tape supply apparatus after the splice is complete and the tape is demanded from the new tape roll with the splicing mechanism returned to its staged positions and further with the rotatable arm of the tape supply station rotated counterclockwise partially;

FIG. 12 is a view of the continuous tape supply apparatus with the rotatable arm of the tape supply station fully rotated by 180° while the tape from the new roll of tape is demanded through the splicing mechanism;

FIG. 13 is a view of the continuous tape supply apparatus like FIG. 12 with the new roll of tape running through the new splicing mechanism but further with yet another new roll of tape loaded to the machine left side with its tape staged within the splicing mechanism for a next splice;

DETAILED DESCRIPTION OF THE PREFERRED EMBODIMENTS

Figure 1:
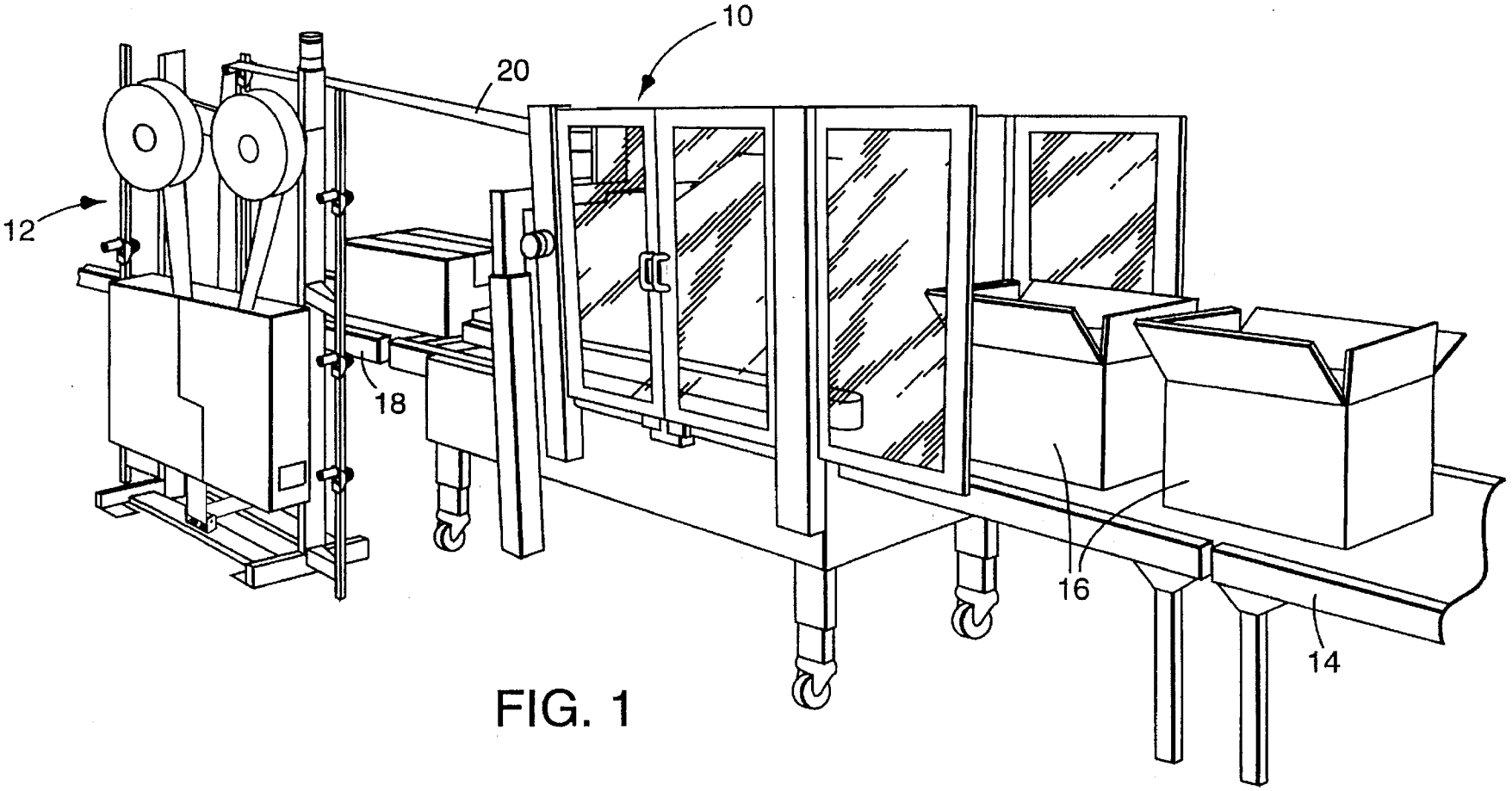
FIG. 1 is a perspective view showing the combination of a continuous tape supply apparatus in accordance with the present invention with a box sealing machine.

With reference now to the drawings, wherein like components are designated with like numerals throughout the several figures, and initially to FIG. 1, a box closing and tape sealing system is illustrated generally comprising a box closing and taping machine 10 and a continuous tape supply apparatus 12. A conveyor system 14 brings boxes or cartons 16 to the box closing and taping machine 10, which preferably folds the top flaps of the boxes 16 and applies a length of adhesive tape to one of or both of the upper and lower surfaces of the boxes 16 in order to seal the top and/or bottom flaps. A second conveying system 18 is illustrated for transporting the closed and sealed boxes from the box closing and taping machine 10.

The box closing and taping machine 10 may comprise any known box taping machine which applies a length of tape to either the top or bottom or both or other surfaces of boxes 16. The machine 10 may not include box closing features and may simply apply tape lengths to a box surface. One specific box closing and taping machine to which the present invention is applicable is described in U.S. Pat. No. 5,323,586 granted Jun. 28, 1994 to Lissoni et al. which is commonly owned by the owner of the subject application and the complete disclosure of which is fully incorporated herein by reference, and which is commercially available from Minnesota Mining and Manufacturing Company of St. Paul, Minn. under the 3M-Matic™ Model 800AF.

The box taping machine 10 may comprise a single taping head (not shown) having an upper taping head or a lower taping head for taping either the upper surface of lower surface of a box that is conveyed through the machine respectively, or may include upper and lower taping heads for taping both the upper and lower box surfaces, respectively. Such taping heads are commercially available from Minnesota Mining and Manufacturing Company of St. Paul, Minn. under the trademark Accu-Glide II. It is further understood that any tape applicator machine, box taping machine or box closing and taping machine could be combined with the continuous tape supply 12 of the present invention.

Box taping machines 10 are characterized in that they have an intermittent demand for tape in the application thereof to boxes or cartons that are moved through the machines. For each box 16 that passes through the box taping machine 10, a definite length of tape is dispensed and applied to each box individually. Thus, for at least a moment between applications to successive boxes 16, there is no demand. Accordingly, the continuous tape supply system 12 must not only supply an uninterrupted length of tape at a usable tension of the box taping machine 10, it must be able to do so with an intermittent demand.

Moreover, the box taping machine 10 together with the conveyor systems 14 and 18 typically comprise part of a packaging production line, and should preferably be able to handle the boxes at the same speed as the packaging production line. Currently, speeds of such packaging lines translate to the need for tape to be dispensed from the tape supply apparatus 12 at speeds of up to 200 feet/minute (61 meters/minute). Of course, the greater the demand for the tape, the more often that the tape rolls of definite length must be replaced. It is thus a specific advantage of the present invention, that even within high speed packaging lines, a continuous tape supply can be provided without the need for shutting down the box taping machine 10 periodically to have the rolls of tape changed. Moreover, as the dispensing speed is increased, the tension within the tape during demand increases, which further results in a greater need for tension control within the supply apparatus, as will be more fully understood from the description of the operation of the present invention below.

The relationship and requirements between such a box taping machine and a continuous tape supply apparatus are additionally set forth in co-pending U.S. patent application Ser. No. 08/067,240 filed May 26, 1993, to Rossini et al., which is commonly owned by the assignee of the subject application and the complete disclosure of which is hereby incorporated by reference.

As shown in FIG. 1, a continuous tape supply apparatus 12 is illustrated for supplying a continuous length of tape 20 to an upper taping head (not shown) of the box closing and sealing machine 10. In accordance with the preferred embodiment, a single continuous tape supply apparatus 12 is provided for each of the taping heads of the box closing and sealing machine 10. Thus, for a lower taping head (not shown), a second continuous tape supply apparatus 12 would be provided. It is envisioned that the second, or more, of such continuous tape supply apparatuses 12 could be provided as its own stand-alone frame, either next to or on the other side of the box closing and sealing machine 10, or they can be provided together on a single frame assembly or the like. For the purposes of the explanation of the subject invention, only a single continuous tape supply apparatus 12 will be referred to with the understanding that such could provide a tape supply for any taping head of any type box sealing machine. In order to guide the tape 20 from the continuous tape supply apparatus 12 to the box closing and sealing machine 10, any number of guide rollers can be provided for controlling the direction and angle of the tape path for the tape 20 from the continuous tape supply apparatus 12 to the box closing and sealing machine 10.

It is also preferable that the tape 20 exits the continuous tape supply apparatus 12 at a relatively low tension, that is, preferably below 1 pound, which it typically required for use by a box closing and sealing machine 10. This relatively low tension is contrasted with the relatively high tension that is often required in order to strip the adhesive tape (depending on the type of tape) from either of the supply rolls of tape, which may be in the order of 3.5 pounds.

Figure 2:
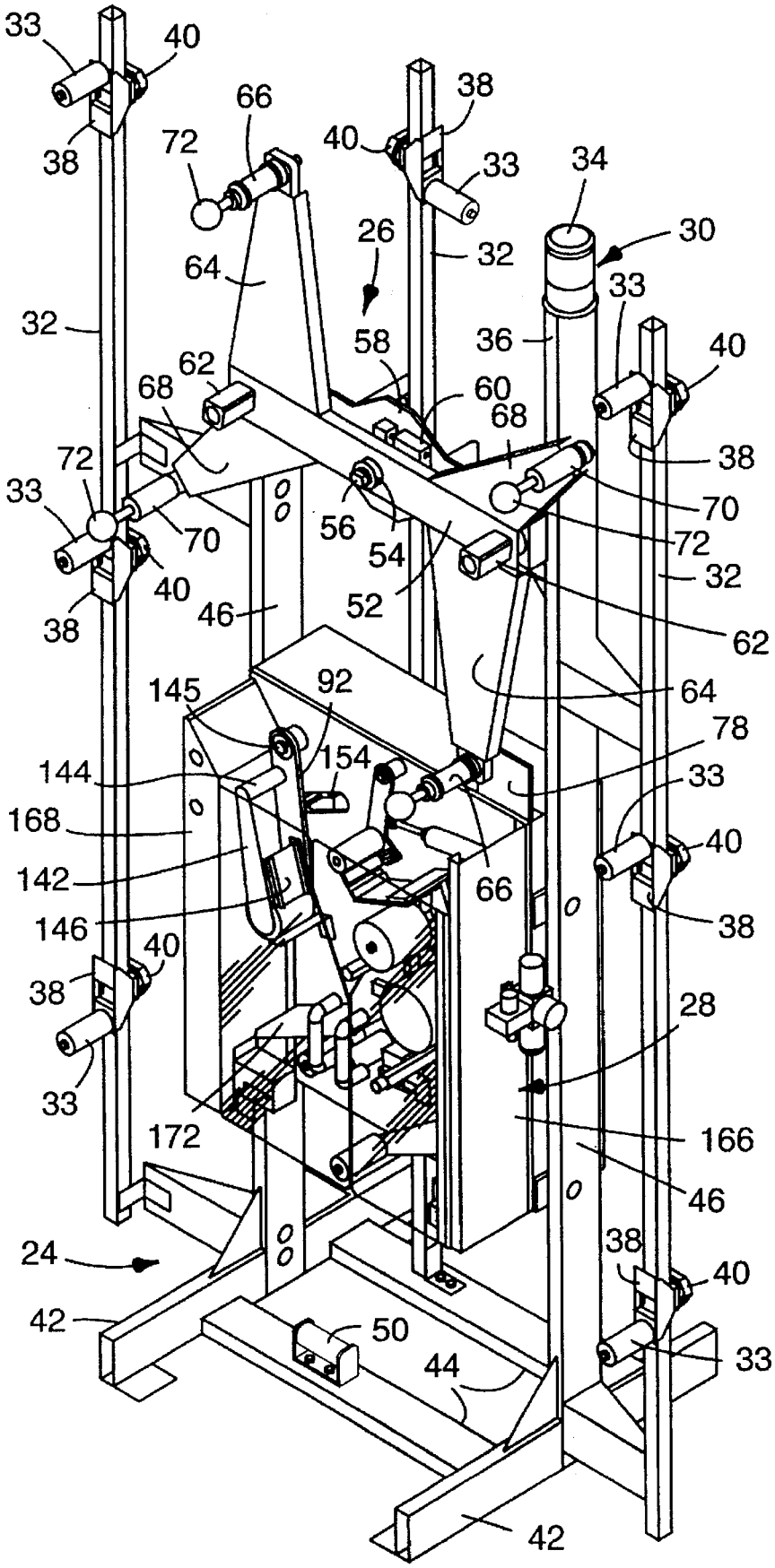
FIG. 2 is an isometric view of a continuous tape supply apparatus in accordance with the present invention.
Figure 3:
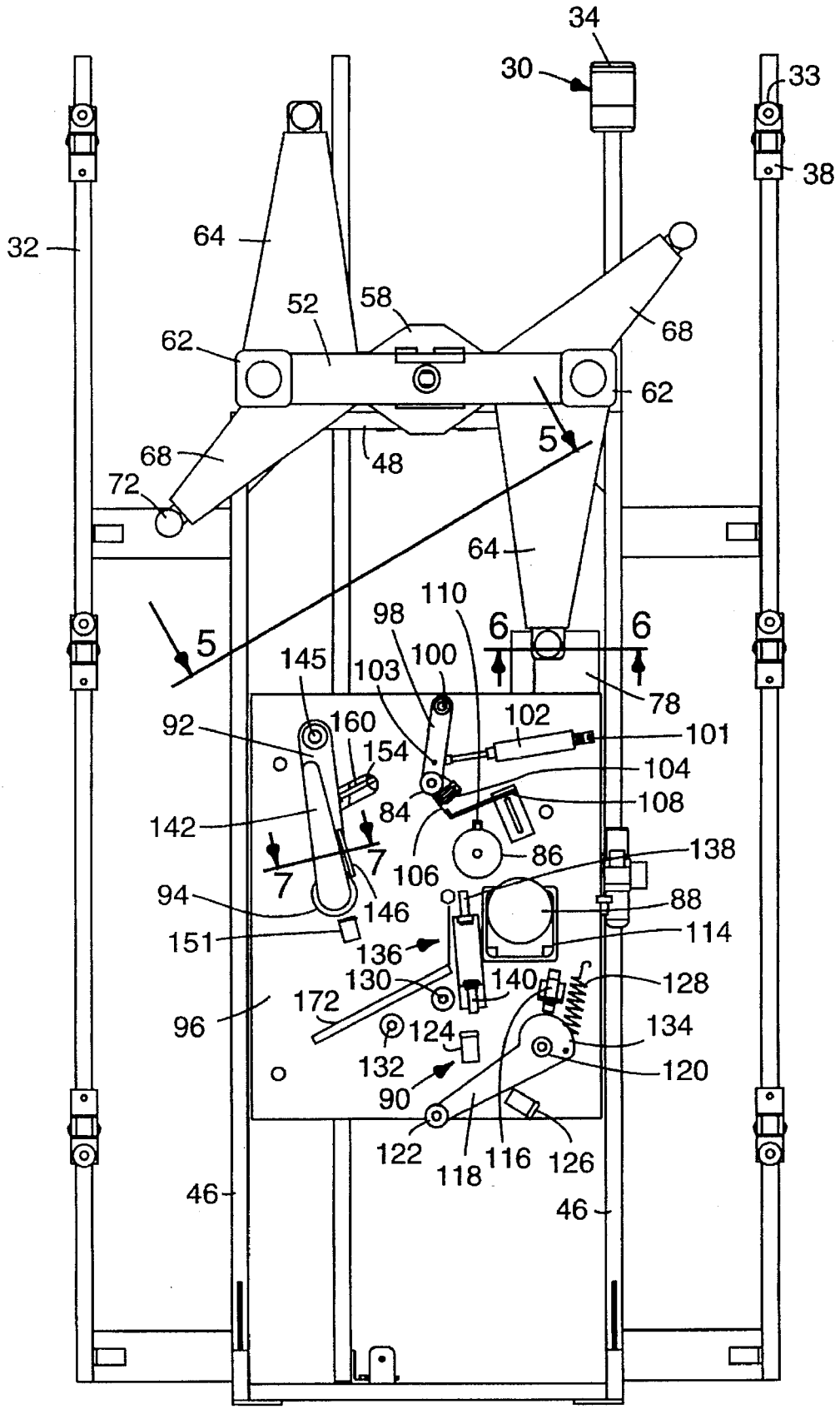
FIG. 3 is a front view of the continuous tape apparatus as shown in FIG. 2, but with the door panels and casing removed for clarity.

With reference now to FIGS. 2 and 3, a continuous tape supply apparatus 12 will be described. The continuous tape supply apparatus 12 is comprised of a support frame assembly 24, a tape supply station 26, and a splicing mechanism 28. The support frame assembly 24 also preferably supports a splice indicator light assembly 30 and at least one tape guide post 32 (three of such tape guide posts are illustrated in FIG. 2) on which a plurality of guide rollers 33 are adjustably mounted. The splice indicator light 30 comprises an indicator lamp 34 and a support tube 36 within which the wiring connecting the indicator lamp 34 to the electrical power system (described below) is preferably run. The guide posts 32 are also preferably connected to the support frame assembly 24 and the guide rollers 33 are preferably adjustably mounted thereto by sliding shoes 38 which ride on the guide posts 32 and which are locked in place by turning knobs 40, each of which includes a threaded element that is driven against the side of the guide post 32 to frictionally hold each shoe 38 in place. Each shoe 38 also preferably includes a support axle onto which the guide roller 33 is freely rotatably conventionally mounted. One or more of the guide rollers 33 can be used for guiding the tape 20 from the continuous tape supply apparatus 12 to the box closing and sealing machine 10 as necessary.

The support frame assembly 24, as shown, comprises a horizontal portion including a pair of spaced legs 42 which are joined together by struts 44, and a vertical portion including a pair of spaced uprights 46 that are fixed with the spaced legs 42. Any manner of fixing the components of the support frame assembly 24 can be utilized as conventionally known. Likewise, the tape guide posts 32 can be conventionally mounted to the support frame assembly 24 by any conventional means including the use of appropriate connector brackets. An upper cross member 48 is also conventionally fixed, preferably at the upper ends of the spaced uprights 46 for providing frame stability and for supporting the tape supply station 26, as described below. Additionally, yet another guide roller 50 is preferably provided to be freely rotatably mounted to one of the struts 44, as shown, for directing the tape 20 from the tape splicing mechanism 28 to one or more of the other guide rollers 33.

The tape supply station 26 comprises a rotatable arm 52 which is preferably pivotally mounted at about its mid-point to the upper cross member 48. Specifically, the rotatable arm 52 preferably includes a bearing 54 which is fixed to rotate with the rotatable arm 52 and which rides on an axle 56 which is fixed to the upper cross member 48 by way of a fixed plate 58. Any conventional bearing assembly could be used as the bearing 54, and the arm 52 can be axially fixed with regard to the axle 56 by any conventional means such as C-clips. More preferably, a friction drag brake 60 is functionally provided between the rotatable arm 52, particularly the bearing 54 thereof, and the upper cross member 48, particularly the fixed plate 58 thereof. The friction drag brake 60 can be any conventional type which restricts rotation of the bearing 54 about the axle 56. More preferably, the friction drag brake 60 is adjustable for changing the drag resistance against the rotation of the rotatable arm 52 about axle 56. As shown, drag brake 60 comprises an adjustable split block mounted to plate 58 which acts against bearing 56 behind arm 52.

The rotatable arm 52 is also preferably provided with a pair of hubs 62, preferably one at each end of the rotatable arm 52. Hubs 62 are freely rotatably mounted to the rotatable arm 52 as conventionally known and may include a braking device for restricting rotation of each hub 62 about its pivot. Again, such braking devices, including friction brakes are well known.

Extending from the sides of the rotatable arm 52, preferably near the ends thereof, are long extension elements 64, each of which supports a guide roller 66 near the end thereof. Also extending from the sides of the rotatable arm 52 near the ends thereof are a pair of short extension elements 68, each of which support a guide roller 70 near the ends thereof. Each of the guide rollers 66 and 70 can be conventionally freely rotatable mounted to the long extension elements 64 and the short extension elements 68, respectively, on an axle, and each preferably includes a knob 72 at an end thereof for facilitating the rotation of the rotatable arm 52 about axle 56 by an operator.

Figure 6:
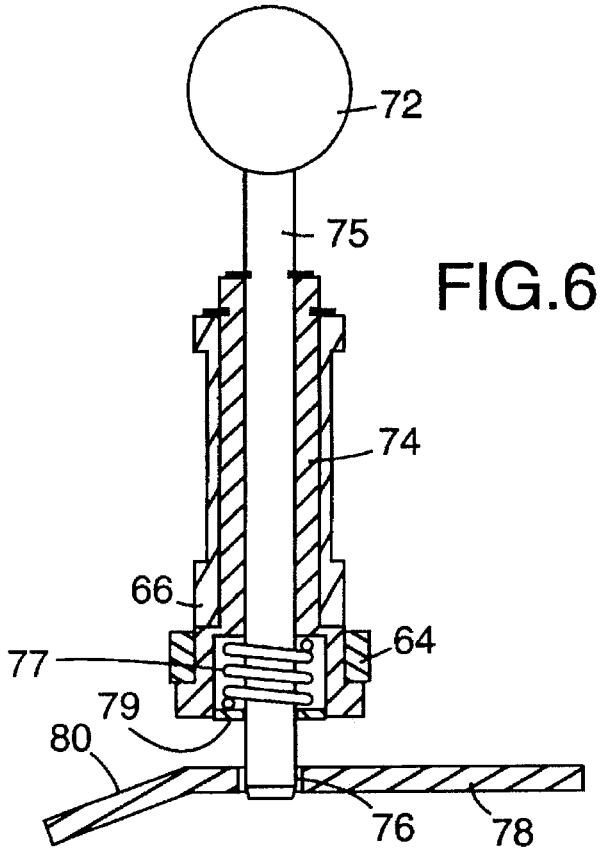
FIG. 6 is a cross-sectional view taken along line 6—6 in FIG. 3.
Figure 7:
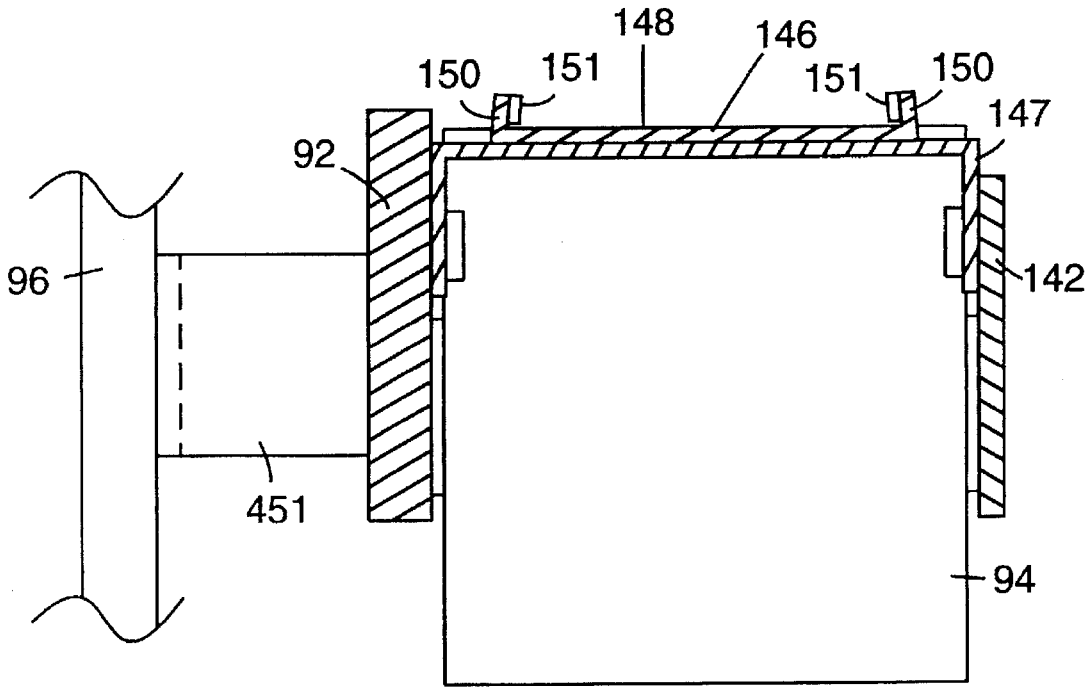
FIG. 7 is a cross-sectional view taken along line 7—7 in FIG. 3.

Moreover, each guide roller 66 is preferably mounted to its long extension element 64 by way of an axle 74 and a retractable pin 75, as shown in FIG. 6. Each pin 75 is axially moveable and biased by a compression spring 77 acting between axle 74 and a retainer 79 fixed to pin 75. The end of pin 75 is thereby selectively engageable within a slot or hole 76 that is provided within a lock plate 78 that is fixed with the splicing mechanism 28, and described below. Additionally, the lock plate 78 preferably includes a ramp surface 80 so that as the rotatable arm 52 is moved counterclockwise as viewed in FIG. 3, the ramp surface 80 will abut the end of pins 75 to move them in their axial direction against the bias of springs 77 so that the pins 75 can be selectively inserted within the slot or hole 76 of the lock plate 78. Thereby, the rotatable arm 52 can be locked with respect to the support frame assembly 24 in either of its two rotated positions.

As part of the control system, a sensor switch 82 (not shown in FIGS. 2 or 3, but shown schematically in FIG. 14) is also preferably provided for sensing when the rotatable arm 52 has been rotated from one of its set positions to the next. To do this, the sensor switch 82 is preferably mounted to the upper cross member 48 and senses when the rotatable arm 52 rotates by it. Preferably, the sensor switch 82 comprises a mechanical limit switch that includes a moveable element such as a roller which extends within the path of rotation of the rotatable arm 52 so that when the rotatable arm 52 is moved from one fixed position to the next, it abuts the moveable element of the sensor switch 82 and throws it to a second position which controls the electrical switch of the sensor switch 82. The purpose of the signal generated by the sensor switch 82 will be described below in connection with the electrical control system. It is also contemplated that any known type sensor switch could be used as the sensor switch 82, including magnetic sensors, photosensors, other mechanical sensors, and the like.

Figure 5:
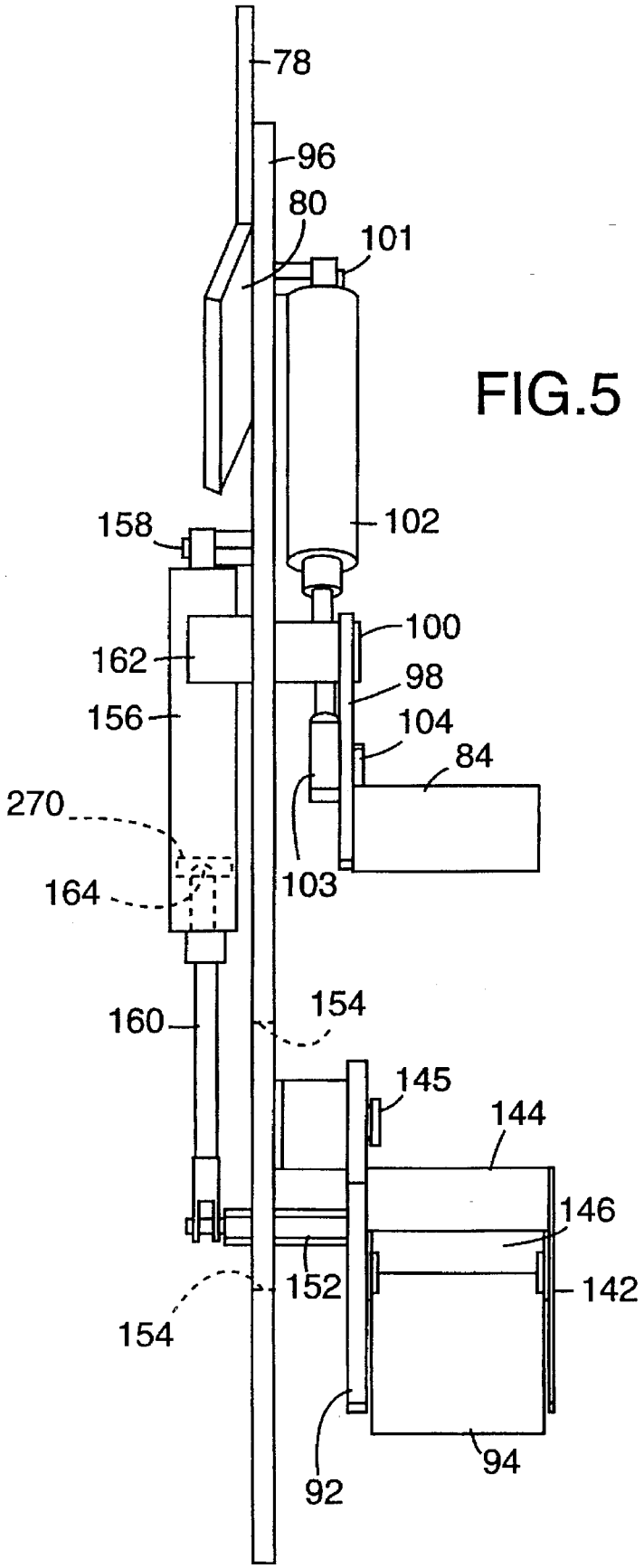
FIG. 5 is a side view taken from line 5—5 in FIG. 3 with certain components removed for clarity showing the support panel and the drive mechanisms for a tension roller and an applying roller of the splicing mechanism of the present invention.

The splicing mechanism, as shown in FIGS. 2, 3, and 5, comprises a means for defining a tape guide path through the splicing mechanism 28, which according to the illustrated embodiment guides tape from the right side of the tape supply station 26 through the splicing mechanism 28, and a means for staging a new roll of tape provided on the left hand side of the tape supply station 26 to be spliced to the tape within the tape guide path on splice actuation. The means for defining the tape guide path preferably comprises a tension roller 84, a backup roller 86, a drive roller 88, and a dancer arm mechanism 90. The means for staging the new tape to be spliced to the tape within the guide path basically comprises an applying arm 92 having an applying roller 94. Each of the elements of the splicing mechanism are preferably supported from a support plate 96 which is operatively connected with the support frame assembly 24 between the spaced uprights 46 by any conventional means.

The tension roller 84 is rotatably mounted to a pivot arm 98 which is in turn pivoted to the support plate 96 at an end distal to the tension roller 84 at pivot 100. The tension roller 84 is preferably only rotational in one direction as provided by a one-way clutch mechanism (not shown) between the tension roller 84 and the pivot arm 98. A first cylinder 102 is provided acting between the support plate 96 at pivot point 101 and the pivot arm 98 at pivot point 103 for moving the pivot arm 98 and thus the tension roller 84 between an extended and retracted position of the cylinder 102. The cylinder 102 preferably comprises an air cylinder which is connected to a pneumatic circuit and control system as will be described below.

Also preferably provided is a bracket 104 on an extension of the pivot arm 98 from the tension roller 84. This bracket 104 is preferably provided to hold a felt pad which can be appropriately oiled, as well known, and which when the cylinder 102 is in its extended position, abuts against a blade 106 which is in turn mounted to the support plate 96 by a blade support assembly 108. It is well known that applying a film of oil to the blade 106 increases blade life and enhances cutting. The blade 106 can comprise any known cutting element as presently known or developed, and preferably comprises a serrated blade.

The backup roller 86 is preferably pivotally mounted to the support plate 96 to be freely rotatable in either direction. A sensor 110 is provided for tracking the rotation of the backup roller 86. Preferably, the sensor 110 comprises a Hall-effect sensor, which are well known per se. Moreover, a magnet (shown schematically in FIG. 14) is preferably provided at one point along the circumference of the backup roller 86, preferably at a position on the inside face of the backup roller 86 near support plate 96. Thus, an electrical pulse will be generated at each instance when the magnet pole passes in front of the Hall-effect sensor. Again, it is understood that any other sensor which can track rotation of the backup roller 86 could be used, including the use of encoders and the like.

Figure 4:
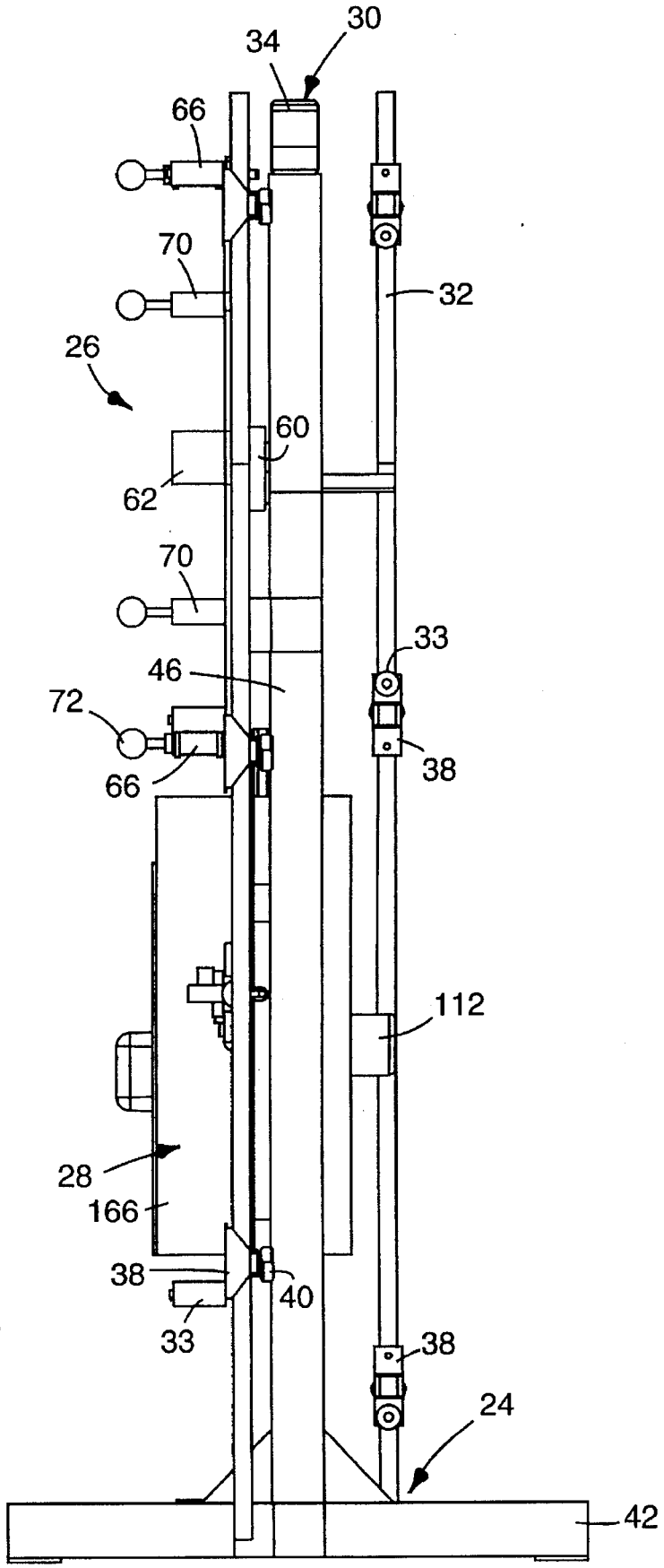
FIG. 4 is a side view of the continuous tape supply apparatus of FIG. 2.

The tape drive roller 88 is preferably driven by a conventional DC current variable speed motor 112, such as available from Baldor Electric Company of Fort Smith, Ak. as motor number GPP12542, which is supported from the support plate 96 on the back side thereof, see FIG. 4, and which includes a drive shaft (not shown) extending through an opening of the support plate 96. A conventional gearbox 114 also preferably operatively connects the drive shaft of the motor 112 to the drive axle (not shown) of the drive roller 88. The motor 112 is preferably further controlled by a motor controller such as a regenerative type which is commercially available from Danfoss, Inc. of Rockford, Ill. as model number R-400. Non-regenerative type motor controllers can also be used, but are believed not as responsive. The function of the motor controller will be more fully explained with reference to the electrical schematic below.

Furthermore, it is an important function of the motor 112 and motor controller thereof to control the tape tension consistently and at the appropriate tension as it exits the continuous tape supply apparatus 12. The motor 112 and controller do this with the help of the dancer arm mechanism 90 and a dancer arm position sensor 116, which is mounted to the support plate 96 adjacent to dancer arm 118. It is the function of the dancer arm position sensor 116 to relay the position of the dancer arm 118 to the motor controller so as to speed up, slow down, or stop the motor 112 and thus its drive roller 88.

The dancer arm 118 is pivotally mounted to the support plate 96 by a pivot 120 at one end thereof and supports a freely rotatable dancer roller 122 at the other end. The dancer arm 118 is moveable between stops 124 and 126 and the dancer arm 118 is preferably biased by a tension spring 128 toward its down position (counterclockwise as viewed in FIG. 3). Idler rollers 130 and 132 also comprise part of the dancer arm mechanism 90 and idler 130 guides the tape between the drive roller 88 and the dancer roller 122 and the idler roller 132 guides the tape from the dancer roller 122 and out of the continuous tape supply apparatus 12.

The dancer arm 118 includes an edge surface 134 which is defined by an increasing radius from the pivot 120 and which is positioned in front of the dancer arm position sensor 116 throughout the movement of the dancer arm from its stop position at stop 124 to its stop position at stop 126. Thus, as the dancer arm 118 moves between its stop positions, an infinite number of positions of the dancer arm 118 can be sensed by the dancer arm position sensor 116 based on the distance between the end of the dancer arm position sensor 116 and the edge surface 134 at any given position.

The dancer arm position sensor 116 preferably comprises an inductive proximity sensor such as available from Turk, Inc. of Minneapolis, Minn. as model number Ni8-M18-LU. In accordance with this preferred embodiment, a signal is generated by the dancer arm position sensor 116 which is greater or weaker depending on the position of the dancer arm 118. Specifically, the signal is varied as the edge surface 134 is moved relative to the dancer arm position sensor 116.

The dancer arm 118 moves upwardly in response to an increase in tension of the tape 20 as it is demanded. When the dancer arm 118 is at its lowermost position toward the stop 126, there is no demand (zero tension) of tape 20, and the motor 388 is not driven. As demand begins, the dancer arm 118 is raised according to the acceleration of the tape 20. This action causes the motor to accelerate the drive roller 88 so as to drive the tape 20 at a substantially consistent and appropriate tension. When the demand for tape 20 is constant, the dancer arm 118 settles at an equilibrium position (somewhere between the upper and lower extremes) which then drives drive roller 88 at a substantially constant speed. When demand is reduced or ceased, the dancer arm 118 moves back downwardly under the influence of spring 128. The motor speed must be reduced accordingly to maintain the desired consistent tension. During the slowing operation of the drive roller 88, it may be necessary to additionally brake the motor 112, especially if there is a sudden decrease or stoppage in demand. Any conventional braking device can be utilized, or a reverse voltage may be applied to the motor to slow it, as is also well known.

As an alternative to the inductive proximity sensor described above, the dancer arm position sensor 116 could instead include a force sensing resistor system, such as that described in co-pending application U.S. Ser. No. 08/067,240 discussed above and incorporated herein by reference. Other sensors that can effectively track the dancer arm position are also useable.

Also positioned along the guide path, preferably between the drive roller 88 and the first idler roller 130 of the dancer arm mechanism 90, is a splice control sensor 136. Preferably, the splice control sensor 136 comprises a photo-electric system that provides a signal to the control module of the subject electrical system, described below, upon the occurrence of a designated event for signaling and activating a splice event. Such a photo-electric system can sense any anomaly of the tape which is provided to trigger the splice event. In accordance with a preferred manner, the tape 20 is provided with a mark or tab along its length at a point near the tape core of the tape roll. Then, when the mark or tab is sensed by the splice control sensor 136, the splice is activated. Preferably, the photo-electric system includes a photo-emitter 138 and a photo-receiver 140, such as those commercially available from Banner Engineering Corporation of Minneapolis, Minn. as model numbers Q196E and Q195P6R. It is understood that other sensors than a photo-electric sensor can be used as the splice control sensor 136, but it is preferable that the sensor activates the splice event at the sensing of some anomaly of the tape indicative of a need to change the tape source. Moreover, it is recognized that the splice control sensor 136 can be positioned anywhere along the tape guide path. Alternatively, instead of looking for an anomaly of the tape, the tape supply roll could be monitored, and the splice triggered upon the sufficient depletion of the tape roll. In this regard, reference is made to the system described in co-pending application Ser. No. 08/067,240 discussed above and incorporated herein by reference. Such an alternative system may be particularly beneficial where colored tapes or other opaque tapes do not permit photosensing through the tape. As yet another alternative, the photo-emitter and photo-receiver could be provided on the same side of the tape and can measure reflectance.

The means for staging a new supply of tape and for effecting a splice by bringing the new tape into contact with the tape provided along the aforementioned tape guide path includes, as discussed above, the applying roller 94 which is preferably freely rotatably mounted to the applying arm 92. A second arm 142 is also preferably provided to rotatably support the applying roller 94 and which is fixed at its other end with the applying arm 92 by a spacer element 144 (see FIG. 2). Thus, both arms 142 and 92 and the applying roller 94 pivot together about a pivot 145 providing the pivotal connection to the support plate 96.

Figure 8:
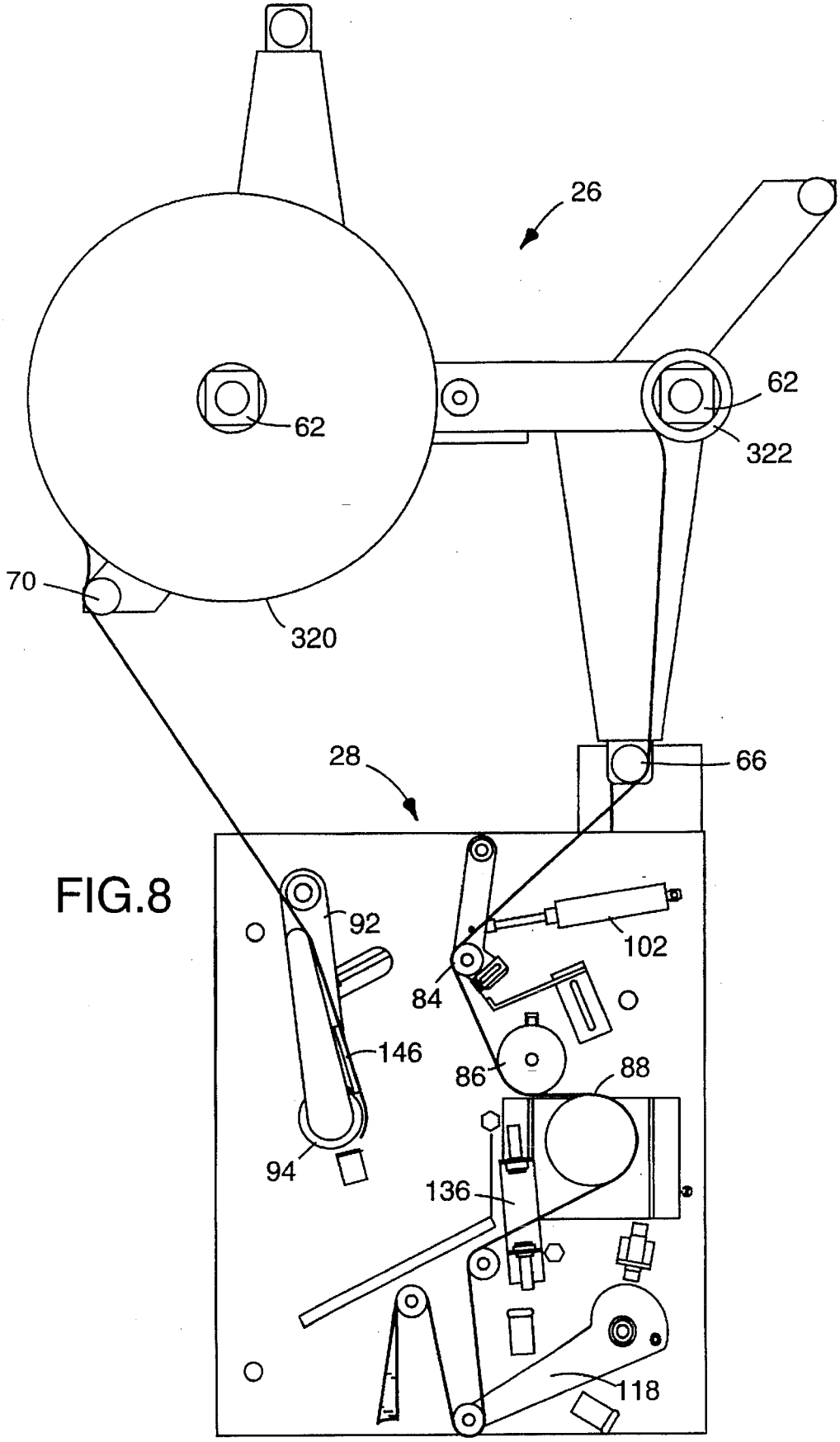
FIGS. 8–13 illustrate the sequence of events for the effectuation of a splice and a changeover from one roll of tape to another of the continuous tape supply apparatus and particularly the splicing mechanism.

Also provided between the second pivot arm 142 and the applying arm 92 is a channel element 146. Preferably, the channel element 146 is mounted to be positioned just adjacent to and tangent to the applying roller 94. As shown in FIG. 8, the channel element 146 is mounted by way of U-bracket 147 and includes a tape support surface 148 and a pair of side guides 150 provided at the opposite edges of the tape support surface 148. Thus, a channel is defined within which the tape from the new tape source can sit when staged. More preferably, the interior surfaces of the side guides 150 are also provided with means 151 for gripping the edges of the tape and for holding the tape substantially against the tape support surface 148. Such means can include any mechanical interference type material, such as a brush surface or other resilient material that may provide a limited interference, such as ribs or grooves and the like. Other means, such as using an easily releasable adhesive, static attraction, or magnetic attraction could also be provided to the tape support surface 148. Preferably, the guide surfaces 150 are provided with loop material of a "hook-and-loop" type fastening system, whereby the loop portions partially interfere with the tape edges to hold the tape in place.

Also preferably provided as a part of the staging means, for the purpose of preparing the tape end of the new tape to be staged, is a fixed cutting element 451 supported by the support plate 96 and located just beyond the applying roller 94. Thus, after a length of tape is pulled from the new roll and positioned on the tape support surface 148 of the channel element 146, the end of the tape can be cut off by the fixed cutting element 451 so as to prepare the leading end of the new tape at a precise position with the tape also lying against the outer surface of the applying roller 94. Then, when a splice event is activated, a proper splice overlap is facilitated.

Figure 10:
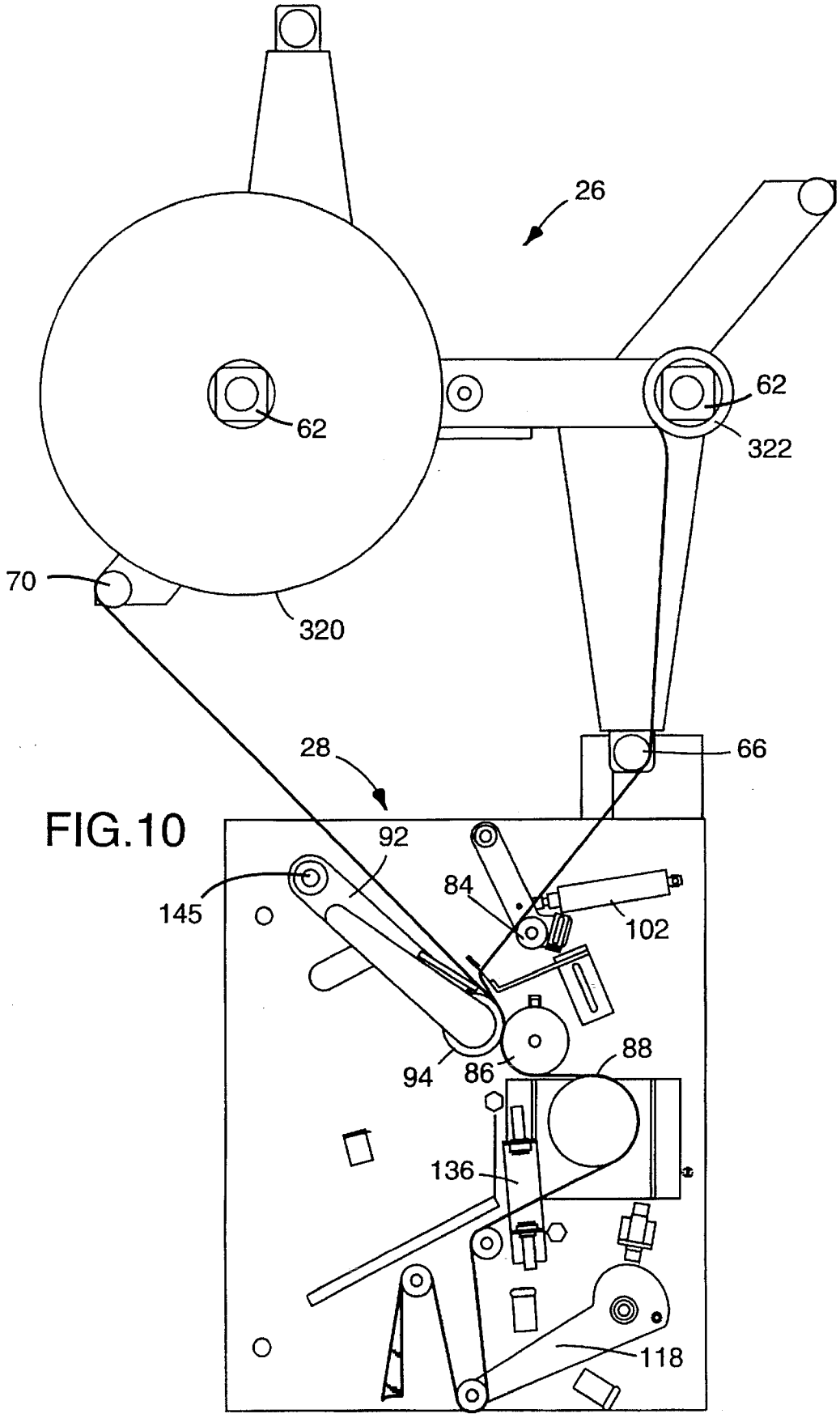

With reference to FIG. 5, the drive mechanism for moving the applying arm 92 and the applying roller 94 between a staged position and a splice position will now be described. From the back side of the applying arm 92, a shaft 152 is provided to move with the applying arm 92 and which passes through a slot 154 of the support plate 96. The shaft 152 is pivotally connected at its other end on the back side of the support plate 96 to a second cylinder 156 which is further pivotally connected to the support plate 96 by a pivot 158. The second cylinder 156 can be actuated between an extended and retracted position as conventionally known and controlled as described below. The slot 154 accommodates the movement of the shaft 152 with the applying arm 92 throughout the entire stroke of the second cylinder 156. In accordance with the illustrated embodiment, when the ram 160 of the second cylinder 156 is fully extended, the applying arm 92 and the applying roller 94 are in the staged position shown in FIG. 3. When the ram 160 is retracted, the applying roller 94 is moved to come against the backup roller 86, as shown in FIG. 10, the geometry of the movement of which will be described in the operation of the apparatus below.

Also provided is a sensor switch 162 for providing a signal to the apparatus electrical control system at the moment when the ram 160 is fully retracted. According to the preferred embodiment, a magnet 164 is mounted to the piston 270 of the ram 160, and the sensor switch 162 comprises a magnetic reed switch which senses the presence of the magnet 164 for closing the switch. Of course, the magnet 164 could be provided at any point along the length of ram 160 as long as the sensor 162 is positioned accordingly, so that a retracted position can be read. The sensor 162 can be conventionally fixed to support plate 96 or cylinder 156. Alternatively, the cylinder 156 could be arranged to position the applying roller 94 in its splice position upon extension. Then, sensor 162 should be positioned to read the extended position. A purpose of sensor switch 162 with its switch is for energizing the solenoid valve (described below) which controls the first cylinder 102 for a delayed retraction thereof. In other words, only after the second cylinder 156 is fully retracted is the first cylinder 102 retracted. The reason for this as well as other aspects of the sensor switch 162 will be more apparent from the description of the operation below.

According to the illustrated embodiment, the drive means for both the pivot arm 98 and the applying arm 92 comprise air cylinders 102 and 156, respectively. However, it is understood that other drive means could be substituted. Specifically contemplated are other pneumatic devices, hydraulic devices, electrically driven motors or solenoids, and/or other mechanical means. Moreover, it is contemplated that the pivot arm 98 and the applying arm 92 can move other than in a pivotal motion. The tension roller 84 and the applying roller 94 can be otherwise driven linearly or along a compound curved or straight path, provided the basic objectives are accomplished.

Referring back to FIG. 2, the splicing mechanism 28 is also preferably provided with at least a partial casing. Specifically, a first side casing 166 is illustrated to the right of the splicer mechanism components and a second side casing 168 is shown to the left side. Additionally, a pair of transparent doors 170 are also provided to close off the front of the splicing mechanism 28. The side casings 166 and 168 and the doors 170 can be conventionally attached to one another and to the support plate 96. Preferably, the doors 170 are designed such that access can be provided by opening one of the doors to the applying arm 92 for staging a new roll of tape without opening the side covering the tape guide path. Further along these lines, it is also preferable to include a shield 172 attached to the support plate 96 and which generally separates the mechanisms of the tape guide path from the mechanism of the staging means.

Figure 14:
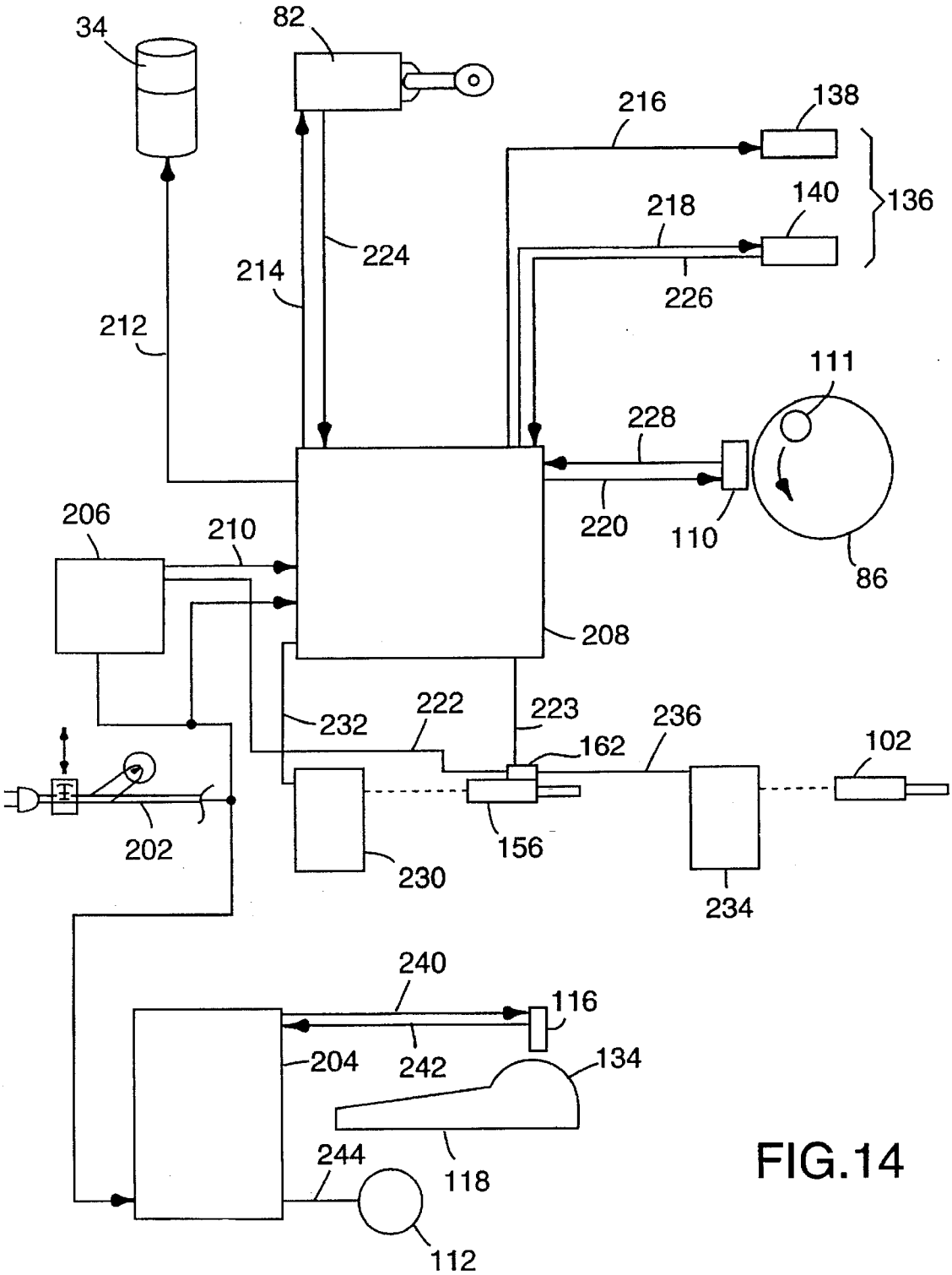
FIG. 14 is a schematic block diagram of the electrical circuit for controlling the motor drive and the operation of the splicing mechanism.

A schematic block diagram is provided in FIG. 14 and illustrates an electrical circuit usable for providing electrical power and controlling operation of the present invention. Specifically, the continuous tape supply apparatus 12 preferably runs off of a conventional AC power line, such as a 120 volt AC line, which is illustrated by line 200 in FIG. 14. A conventional main power switch 202, such as a single pole two-position switch, is provided for energizing the machine. The power line 200 is then preferably connected in parallel to a motor control 204, a control module 208, and a DC power source 206 which comprises a conventional AC to DC rectifier and which preferably provides a DC voltage of 24 volts which is further usable by the system as described below.

The DC power source 206 also provides power to a control module 208 via line 210. The control module 208 is then responsible for providing power to the indicator lamp 34 by line 212, the sensor switch 82 by line 214, the photo-emitter 138 and photo-receiver 140 of splicer control sensor 136 by lines 216 and 218 respectively, and the rotation sensor 110 by line 220 which tracks drive roller 88. The cylinder position sensor switch 162 is preferably powered directly from DC power source 206 by line 222 and is mounted on second cylinder 156. Line 212 preferably provides AC current to the indicator lamp 34, while lines 214, 216, 218, and 228 preferably utilize DC current. The output from sensor switch 82 is connected back to the control module 208 by line 224, the output from photo-receiver 140 is connected back to the control module 208 by line 226, and the output of the rotation sensor 110 back to the control module 208 is made by line 228.

The control module 208 is further connected to a first solenoid valve 230 by line 232. The solenoid valve 230 is operably connected to the cylinder 156 so that upon the selective energizing of the solenoid valve 230 by the control module 208, the cylinder 156 can be extended or retracted. Preferably, the connection between the solenoid valve 230 and the cylinder 156 comprises a pneumatic system controlled by the solenoid valve 230 as will be described below.

As described above, the sensor switch 162 tracks the position of the cylinder 156, specifically when it is retracted. When the cylinder 156 is fully retracted, the sensor switch 162 reads this and connects power from line 222 to a second solenoid valve 234 via line 236 in order to energize the second solenoid valve 234. The second solenoid valve 234 is operably connected with cylinder 102 for extending and retracting the cylinder 102 upon the selective energizing and de-energizing of the solenoid valve 234. Preferably, the connection between the solenoid valve 234 and the cylinder 102 comprises a pneumatic system further described below. The sensor switch 162 is also preferably used to provide a signal back to the control module 208 via line 223 when the retracted position of cylinder 156 is sensed. This signal is used to enable a counting function of the control module 208 which counts the pulses generated by the rotation sensor 110 after a splice event is initiated. In other words, the pulses from rotation sensor 110 are only counted after the second solenoid 234 is energized. A further description of this function is described below.

The object of the control module 208 is to monitor the signals from the various sensors and to activate the indicator lamp 34 and the first and second solenoid valves 230 and 234, respectively, at appropriate times for controlling a splice operation as determined according to its internal logic and the signals received from the various sensors. Note that solenoid valve 234 is also controlled by the position of the cylinder 156 which is in turn controlled by the first solenoid valve 230. In other words, after energizing the first solenoid valve 230, the cylinder 156 can be controlled to be retracted by the pneumatic system, described below, and the sensor switch 162 can then power the second solenoid valve 234 for appropriate action of the cylinder 102. The result is a delay between the retraction of cylinder 156 and the subsequent retraction of cylinder 102. This will be further described below in the description of the operation.

The control module 208 can comprise a circuit board or any conventional logic module including a microprocessor or microchip and the like. In any case, the control module 208 monitors the various sensors and controls the energizing of both solenoid valves 230 and 234 and the powering of indicator lamp 34 at the appropriate times in accordance with the logic described below. The splice control sensor 136, preferably comprising the photo-emitter 138 and photo-receiver 140, determines the initiation of a splice event. Specifically, when the sensor 136 senses a predetermined event, such as a mark or tab provided on the tape surface of a tape roll that is close to depletion, a signal is sent via line 226 from the photo-receiver 140 to the control module 208. Upon receipt of the splice signal, the control module 208 energizes solenoid valve 230 which results in the retraction of cylinder 156. After the time delay defined between the energizing of solenoid valve 230 and the reading by sensor switch 162 that cylinder 156 is retracted, current is connected through the sensor switch 162 via lines 222 and 236 to the solenoid valve 234 which causes retraction of cylinder 102. As will be more fully understood in the description of the operation below, this retraction of both cylinders 156 and 102 initiates a splice. At the same time, the sensor switch 162 also preferably provides the signal back to the control module 208 by way of line 223 which enables the counting function of the control module 208 and additionally triggers the connection of power to the indicator lamp 34, thus signalling the occurrence of a splice. The indicator lamp 34 could otherwise be illuminated based on a signal from the splice control sensor 136 or otherwise.

Both solenoid valves 230 and 234 remain energized until there is an indication of the end of a splice event which is determined by rotation sensor 110. Specifically, the rotation sensor 110 provides a signal pulse to the control module 208 at each occurrence of the passing of the magnet 111 past the rotational sensor 110. However, the control module 208 only begins counting the pulses after its counting function is enabled. According to the present invention, it is preferable that after a splice event has been initiated (signalled by sensor switch 162), the solenoid valves 230 and 234 remain energized until the magnet 111 passes the rotation sensor 110 twice. This ensures that a minimum of one full rotation of the backup roller 86 will occur before the solenoid valves 230 and 234 are de-energized.

The purpose of this is to hold the applying roller 94 against the backup roller 86 over the tape splice and to make sure that the spliced area is moved down and around the drive roller 88. This is particularly advantageous in that the force of any initial tape tension on the tape and particularly on the splice area can be taken up, at least in part, by the drive roller 88. Thus, at the determination of the end of a splice event, after the magnet 111 passes the rotation sensor 110 twice, both solenoid valves 230 and 234 are de-energized, preferably at the same time, and both cylinders 156 and 102 are again extended.

The purpose for providing the sensor switch 82 is so that after a splice has occurred and an operator is signalled of the occurrence by the indicator lamp 34 and the operator rotates the rotatable arm 52 of the tape supply station 26 from one fixed position to its subsequent fixed position, the indicator lamp 34 will be turned off. More specifically, as described above, when the rotatable arm 52 is rotated, it abuts the roller portion of sensor switch 82 which signals the control module 208 to turn off the indicator lamp 34.

Also shown in FIG. 14 is the power and control system of the motor 112. Specifically, the system comprises a motor controller 204 that supplies current to a proximity sensor 116 by line 240 and which reads the position of the dancer arm 118 as described above and returns a signal back to the motor controller 204 via line 242. The motor controller 204 is connected with the AC power source also by line 200 and is responsible for providing the necessary output in DC current via line 244 to the motor 112 depending on the strength of the signal provided from the proximity sensor 116. Preferably, the DC motor 112 responds proportionally to the change in output provided by the motor controller 204 which in turn increases its output proportionally depending on the strength of the signal from proximity sensor 116. As viewed in FIG. 3, dancer arm 118 is biased downward. An increase in tape tension will tend to rotate dancer arm 118 clockwise which causes the edge 134 of the dancer arm 118 to move farther away from the proximity sensor 116. The signal from the proximity sensor 116 is changed corresponding to the increase in distance, and the motor controller 204 uses the change in signal from the proximity sensor 116 to proportionally increase the drive speed of the motor 112. This, in turn, reduces tape tension and allows the dancer arm 118 to fall into an equilibrium position. The motor controller can respond continuously to the changes in tape tension as they affect the dancer arm 118 and can accommodate the intermittent demand characteristic of tape applying machines, as described above.

Figure 15:
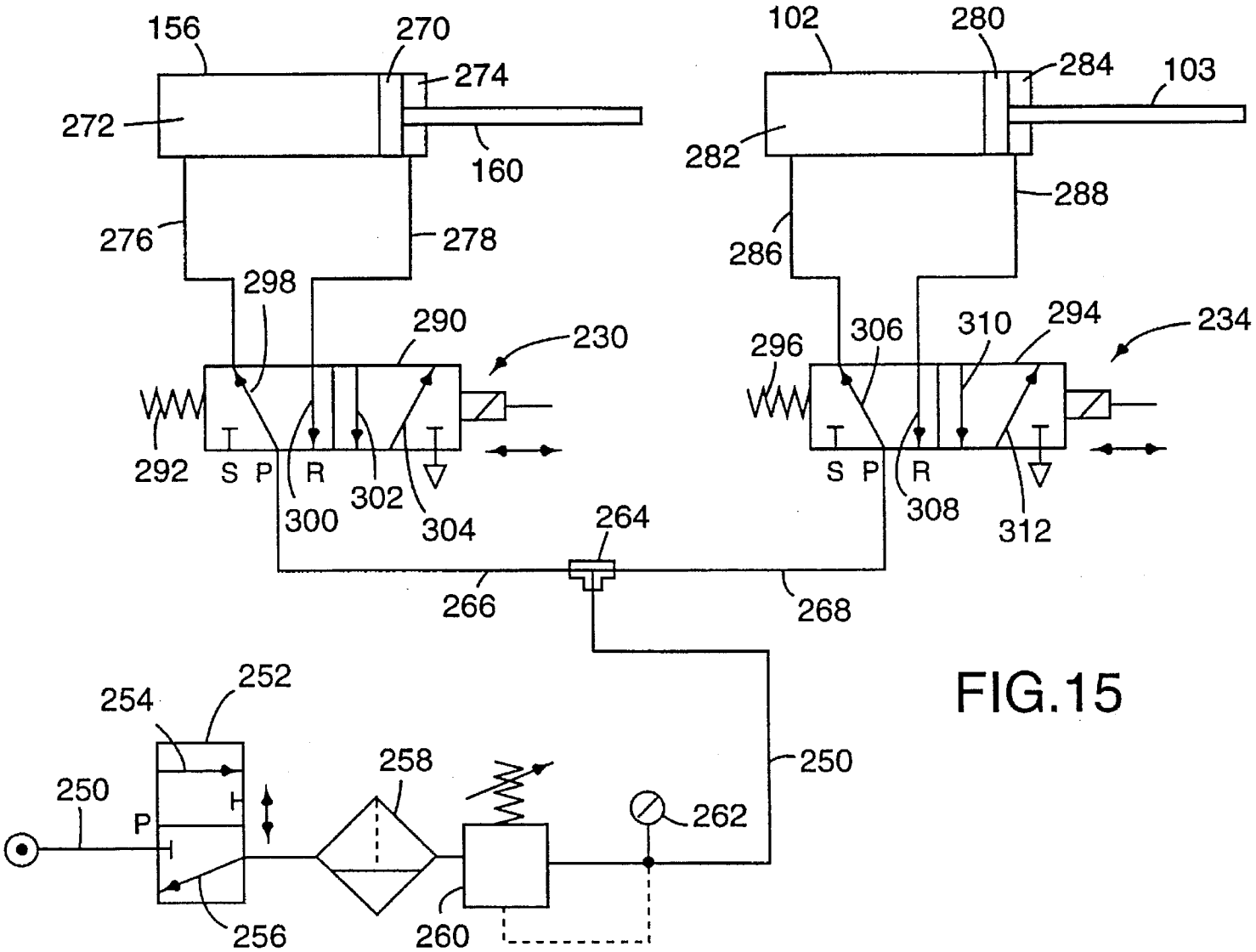
FIG. 15 is a schematic diagram of the pneumatic circuit used for operating the splicing mechanism under the control of the electrical system.

Referring now to FIG. 15, a pneumatic schematic diagram is illustrated which represents a suitable pneumatic system usable in accordance with the present invention and in conjunction with the above-described electrical system for controlling the operation of cylinders 156 and 102 and thus the splicing operation. The system includes an input line 250 which is conventionally connected with a pressurized air source (not shown) and which supplies sufficient pressurized air for operating the system as described below. The input line 250 preferably passes through a system, an exhaust valve 252, as conventionally known, which when shifted downwardly as viewed in FIG. 15 completes line 250 by way of the passage 254. A second passage 256, as shown in the position of FIG. 15, is used to exhaust air from the line 250 and the remaining system when the switch 252 is in the upward position. Line 250 then preferably passes through a conventional filter 258, a pressure regulator 260 and a pressure gauge 262, which together ensure the adequate supply of air pressure for running the pneumatic system.

The input line 250 is then split at a T-fitting 264 into lines 266 and 268 which preferably evenly supply pressurized air to the first solenoid valve 230 and the second solenoid valve 234 respectively.

The cylinder 156 is conventionally divided by a piston 270 into chambers 272 and 274 on either side of piston 270. Piston 270 is fixed to ram 160 for moving the ram 160 therewith. Line 276 connects the chamber 272 with the first solenoid valve 230 and line 278 connects chamber 274 with the solenoid valve 230. Likewise, cylinder 102 is divided by a piston 280 into chambers 282 and 284 provided on either side thereof. Piston 280 is fixed with ram 103 for moving the ram 103 therewith. Chamber 282 is connected with the second solenoid valve 234 by line 286 and chamber 284 is connected with the second solenoid valve 234 by a line 288.

Solenoid valve 230 comprises a valve body 290 which is preferably biased by a spring 292 to the right as viewed in FIG. 15. When the solenoid valve 230 is energized, the valve body 290 shifts to the left as viewed in FIG. 15 against the bias of spring 292. Likewise, solenoid valve 234 comprises a valve body 294 which is biased by a spring 296 towards the right as viewed in FIG. 15 and so that energizing the solenoid valve 234 causes a shift to the left against the bias of spring 296.

Valve body 290 of the solenoid valve 230 includes a first set of passages on one side of the valve including pressure passage 298 and return passage 300. On the other side of the valve body 290, a return passage 302 and a pressure passage 304 are provided. When the valve body 290 is positioned under the influence of spring 292 in the position illustrated in FIG. 15, pressurized air from line 266 passes through pressure passage 298 and supplies pressurized air to chamber 272 of cylinder 156 via line 276. At the same time, chamber 274 is connected through line 278 to the return passage 300 which is open to the outside. In this condition, the piston 270 is shifted to its limit to the right as shown in FIG. 15 and the ram 160 is fully extended. When the solenoid valve 230 is energized, the valve body 290 shifts to the left and the pressure line 304 is connected between line 266 and line 278 for supplying air pressure to chamber 274 while line 276 from chamber 272 connects to return passage 302 which is open to the outside. Under this condition, the piston 270 will move to its leftmost limit as viewed in FIG. 15, and the ram 160 will be fully retracted.

Valve body 294 of the solenoid valve 234 includes a first set of passages on one side of the valve including pressure passage 306 and return passage 308. On the other side of the valve body 294, a return passage 310 and a pressure passage 312 are provided. When the valve body 294 is positioned under the influence of spring 296 in the position illustrated in FIG. 15, pressurized air from line 268 passes through pressure passage 306 and supplies pressurized air to chamber 282 of cylinder 102 via line 286. At the same time, chamber 284 is connected through line 288 to the return passage 308 which is open to the outside. In this condition, the piston 280 is shifted to its limit to the right as shown in FIG. 15, and the ram 103 is fully extended. When the solenoid valve 234 is energized, the valve body 294 shifts to the left and the pressure line 312 is connected between line 268 and line 288 for supplying air pressure to chamber 284 while line 286 from chamber 282 connects to return passage 310 which is open to the outside. Under this condition, the piston 280 will move to its leftmost limit as viewed in FIG. 15, and the ram 103 will be fully retracted.

With reference to FIGS. 8–13, the description of the operation of the preferred embodiment of the subject apparatus described above is as follows. FIGS. 8–13 are similar to FIG. 3 described above but with the addition of tape rolls 320 and 322 shown mounted on hubs 62 of the tape supply station 26. Moreover, much of the apparatus support structure is removed in these Figures in order to clearly illustrate the relationship between the tape supply station 26 and the splicing mechanism 28. The preferred embodiment described above is designed to handle tape application speeds of 200 ft/min (61 m/min) under indexing demand situations as described above. Under most indexing demand situations, the continuous tape supply apparatus 12 preferably has a particular total tension control which is used to effectively control the tape demand under a relatively consistent tension. This capacity is dependent on the particular situation and is a function of the mass of the tape roll 320 or 322, the tape speed, and the tape tension.

The total tension control can be made up by a combination of the drive roller 88 and the motor controlling dancer arm 118. More specifically, the amount of tape within the loop of the dancer arm 118 combined with the motor drive system defines the tension control of the illustrated machine. It is understood that the size of the loop can compensate for another tension control, such as the drive roller 88. In other words, the tension control could be provided by any one of the variables or any combination thereof. For example, a decrease in motor drive (even to zero) would require an increase in loop size formed by the dancer arm. In this regard, it is noted that the loop size can be provided by a single dancer arm, as shown, or one or more additional loops could be provided anywhere along the tape guide path through the machine. It is understood, however, that loop size may be dependent on its position along the tape guide path with regard to the other tension control elements.

Thus, it can be seen that under low speed requirements or where the demanded tape tension can be relatively high, a minimum of total tension control is required. In high speed applications where relatively low tape tension is required, greater tension control is required.

With reference to the Background section of the present application, the preferred embodiment of the subject invention fits in the category of an "on the fly" splicing mechanism. That is, the splice is triggered by the moving tape. Moreover, the movement of the tape actually makes the splice. On the other hand, it is a particular advantage of the subject machine that the splice need not be completed during a moving period of the tape uninterrupted by a rest period. In other words, the splice can be initiated, a rest period can occur, and then, when the tape resumes movement, the splice can be completed. This is because the applying roller 94 stays against the backup roller 86 until a predetermined length of tape is demanded, preferably for a minimum of a full rotation of the backup roller 86. It is understood that the amount of tape dispensed during this application stage can be modified as determined for each particular application, and with the preferred embodiment, the logic need only be changed by changing the number of pulses counted after the splice occurs.

With reference initially to FIG. 8, a detailed description of the operation of the preferred embodiment of the present invention follows for a complete changeover from a nearly depleted roll of tape, roll 322, to a new roll of tape, roll 320. FIG. 8 illustrates the tape supply station 26 and the splicing mechanism 28 with the tape from tape roll 322 nearly depleted but running along the tape guide path of the splicing mechanism 28 and with the tape of the tape roll 320 staged on the applying mechanism comprising the applying arm 92 and applying roller 94. The splicing mechanism 28 is configured in a normal running position with a new roll of tape staged for a next splice.

In this normal running position, tape from roll 322 is threaded around guide roller 66, tension roller 84, backup roller 86, drive roller 88, idler roller 130, dancer roller 122, and idler roller 132, in that order, and preferably as shown. Also in this normal running position, the cylinder 102 is fully extended, which means that the solenoid valve 234 is de-energized, as described above. Note that the tape between the tension roller 84 and backup roller 86 is adequately to the side of the blade 106. Also note that the tape from drive roller 88 to the first idler roller 130 passes through the splice control sensor 136.

In order to stage the tape from the new roll 320, the tape is pulled and run around guide roller 70 and is positioned against the tape support surface 148 of the channel element 146 which moves with the applying arm 92. Preferably, in order to ensure a good splice, during the staging process, the tape is run past the channel element 146, over the applying roller 94 and beyond the staging cutter 151. Then, the tape is cut by the staging cutter 151 which presents the leading edge of the tape from tape roll 320 in a preferred position for the splice. Note that the position of the leading edge of the tape is defined to take advantage of the geometry of the preferred design so that the leading edge will be positioned on the applying roller at the proper position for an effective splice, as will be further described below. Also note that the material provided on the guide surfaces 150 of channel element 146 preferably holds the tape by its edges substantially against the tape support surface 148.

Figure 9:
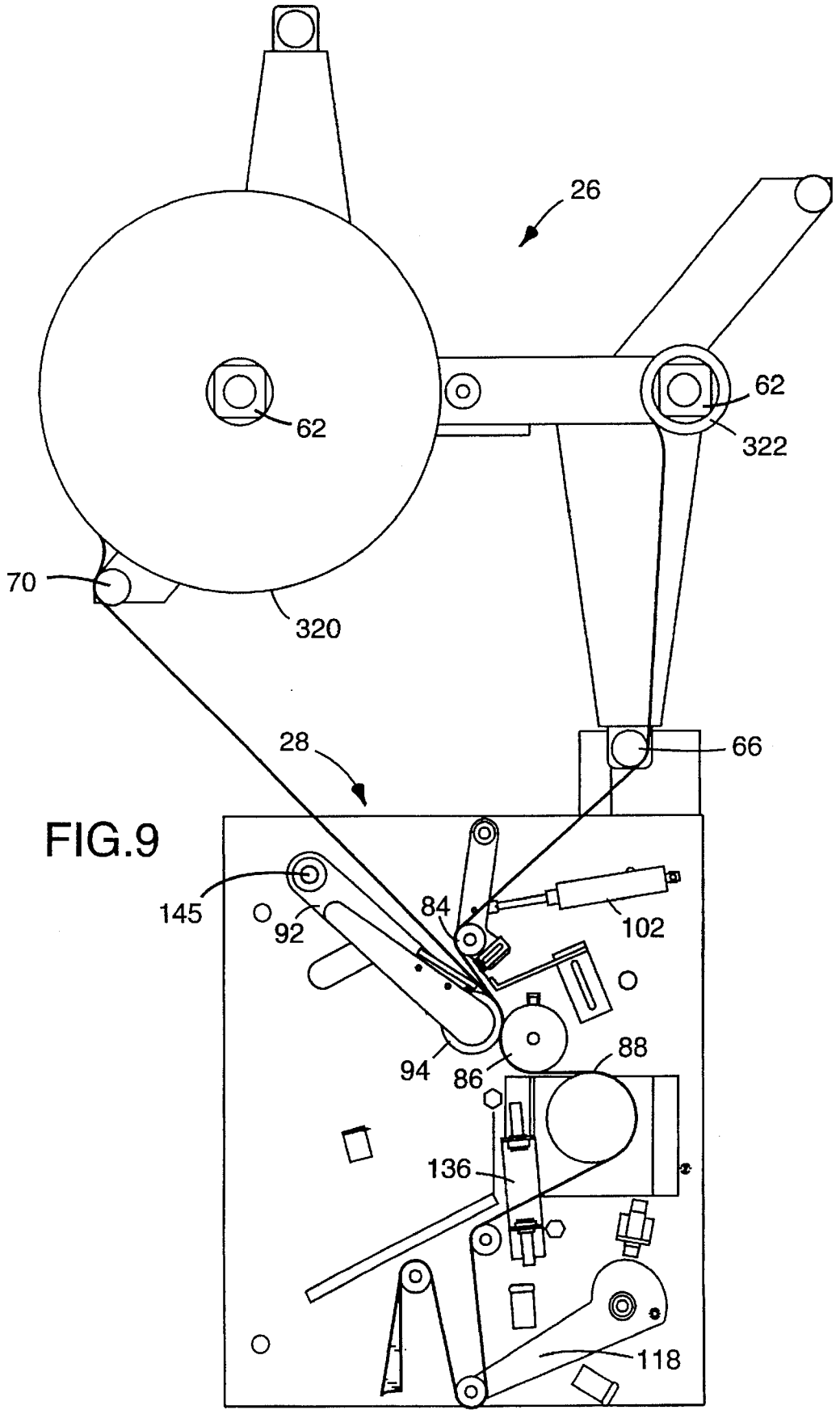

The configuration of the splicing mechanism 28 stays as shown in FIG. 8 until a splicing event is triggered. Preferably, such occurs by the sensing of an appropriate mark or tab provided on the nearly depleted tape of tape roll 322 which is read by the splice control sensor 136. When a splice event is triggered by sensor 136, the cylinder 156 is immediately retracted based upon the signal from the splice control sensor 136, specifically, the photo-receiver 140. This retraction results in the applying arm 92 and applying roller 94 being swung from their stages position to a position where the applying roller 94 is urged against the backup roller 86. This position is shown in FIG. 9. Note that the tension roller 84 has not yet moved and the tape from tape roll 322 is still running along the guide path defined as the normal running position which prevents the tape from roll 322 from being cut at this point.

It is important to note that it is a preferable design feature of the present invention that the applying roller 94 be moved into a splice position that actually interferes with the tape guide path, particularly that portion between the tension roller 84 and the tape backup roller 86. As shown in FIG. 9, the tape path is changed from that shown in FIG. 8 in that the tape from roll 322 wraps partially around the applying roller 94. Moreover, the applying roller 94 also preferably moves against the backup roller 86 (with the tape splice therebetween) with the contact point lying below a line connected between the pivot 145 of arm 92 and the axis of rotation of backup roller 86 (that is, the closest surface of the backup roller 86 is closer to the pivot 145 than the distance from pivot 145 to the farthest surface of applying roller 94) so that any further force urging the applying roller 94 toward backup roller 86 will be against the backup roller 86. This feature has been found to help ensure an effective splice.

The geometry of the applying arm 92 and roller 94 is also preferably designed so that as the applying arm 92 is moved from its staging position to its splice position, the leading edge of the tape from roll 320 moves to a point along the circumference of the applying roller 94 that becomes the contact point with the tape from roll 322 on backup roller 86. Again, this helps ensure a good splice with the leading edge of the tape from roll 320 firmly adhered to the tape from roll 322. The interference positioning described above provides a partial wrap of tape about both rollers 94 and 86, which gives some leeway in the exact positioning of the leading edge of the tape from roll 320. On the other hand, it is understood that an interference position of the applying roller 94 is not required and that a simple nip could be provided between the applying roller 94 and the backup roller 86 without altering the tape guide path from roll 322.

Once the cylinder 156 has fully retracted, the cylinder position sensor switch 162 energizes the second solenoid valve 234 which results in the retraction of cylinder 102. As described above, the amount of delay in retracting cylinder 102 is the time that it takes cylinder 156 to fully retract. FIG. 10 shows cylinder 102 retracted while the applying roller 94 is urged against backup roller 86. By this movement of the tension roller 84, the tape path of the tape from roll 322 is further modified so that the tape is brought against the blade 106 which severs the tape from roll 322 during such movement. At this point, tape is no longer being demanded from roll 322, and roll 320 is thereafter depleted. The delay period also helps ensure an effective splice in that the splice is started while the tape from roll 322 is still under tension between tension roller 84 and the backup roller 86. The tape from roll 322 in then cut while the applying roller 94 and the backup roller 86 keep the tape splice together.

The applying roller 94 and the tension roller 84 remain in this position with a splice initiated until the splice is deemed completed, which occurs only after the backup roll 86 rotates a minimum of a full rotation. As described above, this is preferably determined by the magnet 111 passing the rotation sensor 110 twice after the sensor switch 162 enables the counting operation of the control module 208. By this time, the splice overlap zone is preferably moved to a position somewhere about the drive roller 88.

When the rotation sensor 110 senses two passes of the magnet 111, the splice is deemed complete, and the control module 208 de-energizes both solenoid valves 230 and 234, preferably simultaneously. Thus, the normal tape guide path position of the tension roller 84 and the staging position of the applying mechanism are re-established. However, tape is demanded from the new tape roll 320 on the new roll side of the machine while the running side is depleted.

Figure 11:
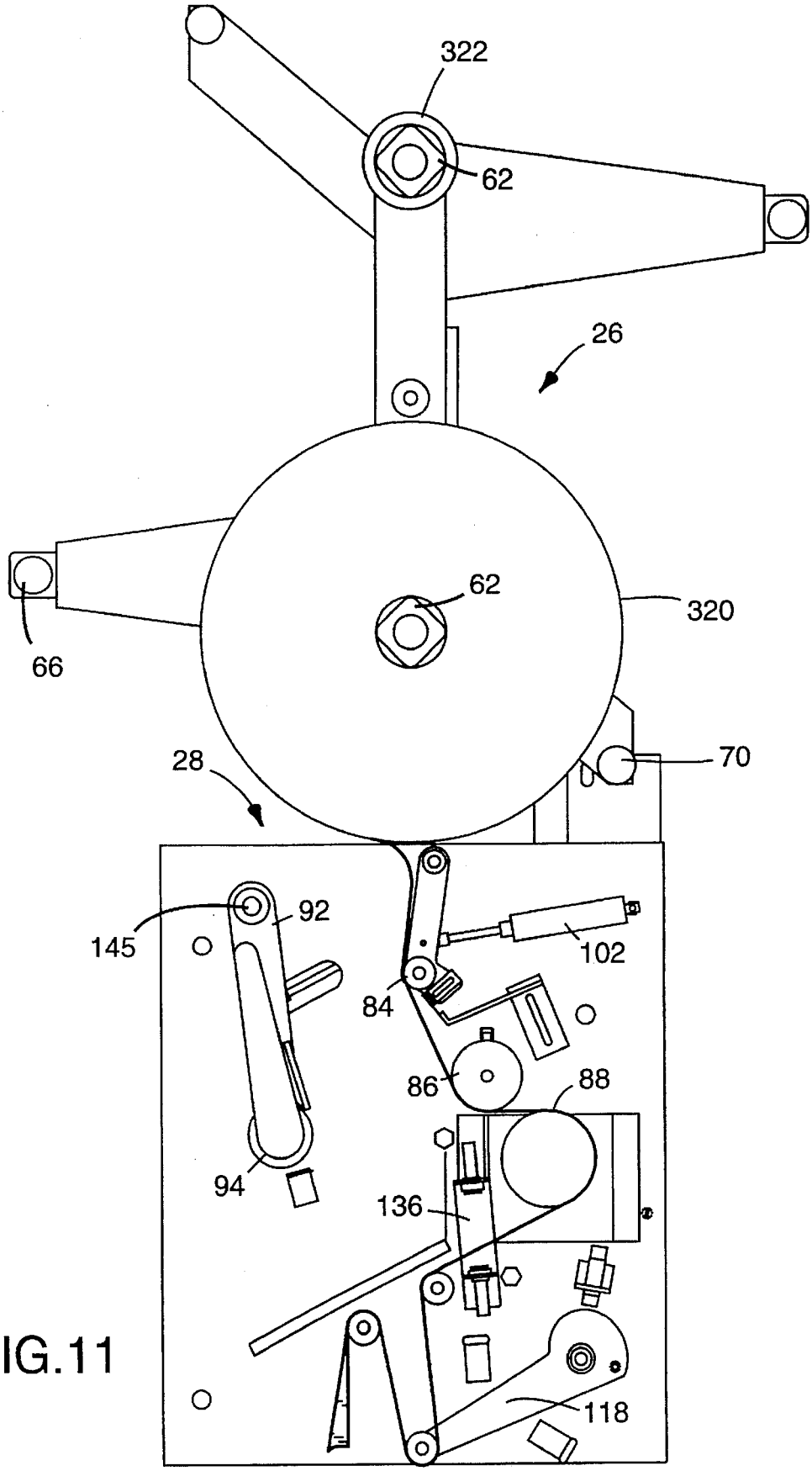

As shown in FIG. 11, the normal tape guide path in its running position is illustrated with the applying mechanism in its staged position. The tape supply station 26 is illustrated with the rotatable arm 52 rotated by approximately 90° which represents a transition period as the new roll of tape 320 assumes the running position of the machine. As described above, to rotate the rotatable arm 52, an operator preferably pulls the one of the knobs 72 which is engaged within the slot or hole 76 of the lockplate 78 and then the rotatable arm 52 is rotated.

Figure 12:
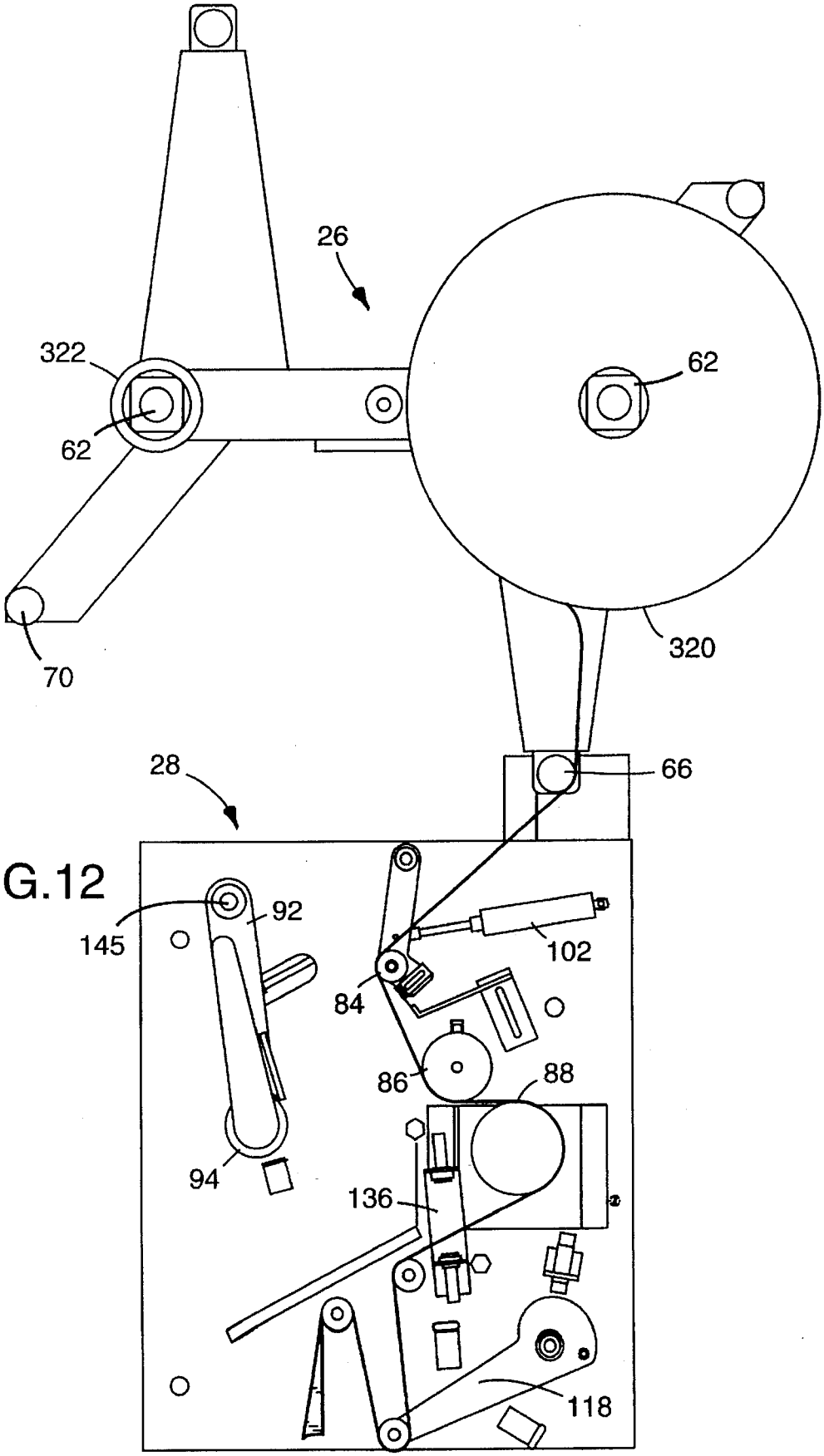

FIG. 12 is similar to FIG. 11 except that the roll 320 has been fully moved to its running position and the other of the knobs 72 and its pin 75 has engaged within the slot or hole 76 of lockplate 78. The new roll side of the tape supply station 26 needs now to be re-loaded with yet another new roll of tape. All the meanwhile, tape is under demand from roll 320. Also note that the tape being depleted from roll 320, as the rotatable arm 52 rotates through 180° to its next position, changes from running around guide roller 70 to running around guide roller 66 of the same side of the tape supply station 26 (see FIGS. 10–12).

Figure 13:
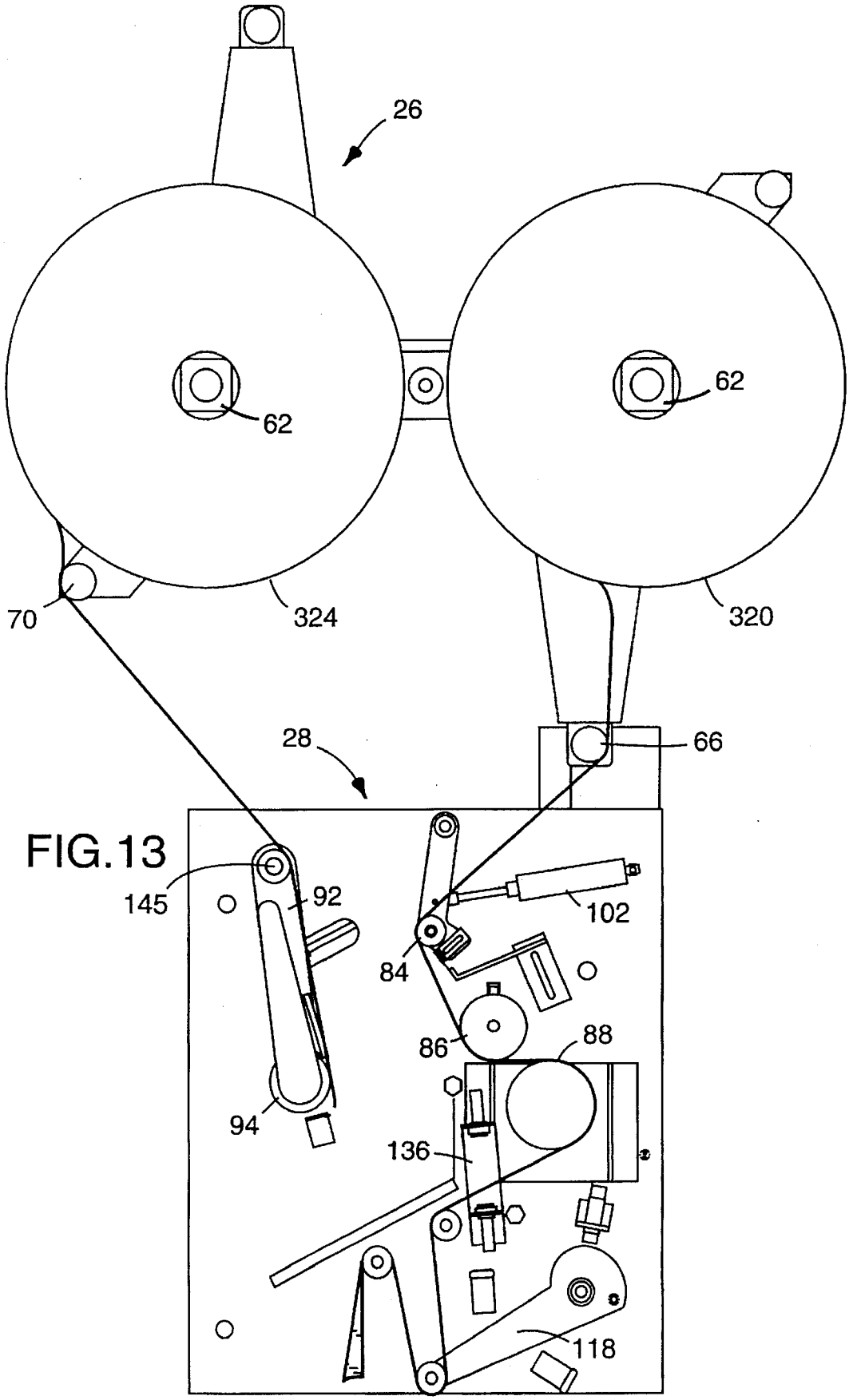

Lastly, as shown in FIG. 13, the tape roll 320 is running through the normal tape guide path while yet another new roll of tape 324 is staged in the same manner as described above. Roll 324 will remain staged until the tape roll 320 becomes depleted and a splice event is triggered by the predetermined sensing that the tape roll is depleted. Of course, the tape roll 324 need not be staged until at least just before the tape roll 320 is depleted in order to ensure a continuous tape supply. This advantageously gives the operator the entire time during which tape from tape roll 320 is depleted until a new roll 324 must be loaded. Furthermore, as described above, the indicator lamp 34 will be illuminated at the occurrence of a splice event and will not be shut off until after the rotatable arm 52 is rotated from one position to its next subsequent position (approximately 180°). Sensor switch 82 is responsible for turning off the indicator lamp 34 at such occurrence. It is further understood that the tape could run through the splicing mechanism 28 as shown in FIG. 11 with the tape roll 320 still in its staged position shown in FIG. 10. The tape could be demanded in this condition of the splicing mechanism and the tape supply station 26 until it is desirable to load a new roll of tape. During this time, tape simply passes around guide roller 70 directly to the backup roller 86 without passing over the tension roller 84. During this time, the indicator lamp 34 will remain illuminated.

Another significant advantage of the preferred design of the present invention having a rotatable tape supply station 26 and a single directional splicing mechanism is that the overlap of each subsequent splice is in the same preferred manner. That is, it is preferred that the adhesive surface of the new tape be applied to the backing of the old tape.

It is understood that the above description is of a preferred embodiment of a continuous tape supply apparatus 12 which uses a preferred splicing technique. Moreover, it is understood that the manner of effecting the splice can be modified in many ways without departing from the scope of the present invention. Many other means are contemplated for activating and controlling the splicing operation instead of the air cylinders and logic control module. Furthermore, it is contemplated that additional control systems could be incorporated within the present device for minimizing or eliminating other operator functions. The control systems can be mounted directly onto the apparatus or can be separately provided.

As to the tape supply station, it is contemplated that more than two tape rolls can be supported. It is preferable that each hub be located evenly about a rotating station so that the station need be rotated by the same amount and in the same rotational direction, for example by 120° in the case of three evenly spaced rolls. An advantage of more than two tape rolls is that the tape supply station needs to be rotated less after each changeover.

We claim:

1. A continuous tape supply apparatus for supplying adhesive tape to a tape applicator machine, said continuous tape supply apparatus comprising:

a) a support;

b) a first tape source station provided on said support for receiving a first tape supply source and from which adhesive tape of the first tape supply source can be dispensed;

c) a second tape source station provided on said support for receiving a second tape supply source and from which adhesive tape of the second tape supply source can be dispensed;

d) a splicing means provided on said support for splicing tape from said second tape source station to tape from said first tape source station using a lap splice without requiring any separate splicing tape and while continuing to supply adhesive tape to the tape applicator machine without stopping the supply of adhesive tape, so as to change the supply of tape from the first tape supply source to the second tape supply source, said splicing means comprising guide means for defining a tape guide path through said splicing means to be supplied from the continuous tape supply apparatus to the tape applicator machine, a staging means comprising an applicator element which is movably disposed on said support between a staring position with said applicator element spaced from said tape guide path and a splice position with said applicator element moved within said tape guide path to change said tape guide path, and control means for causing the applicator element to move from its staging position to its splice position upon the occurrence of a determined event and for moving the applicator element from its splice position back to its staging position, wherein said guide means for providing a tape guide path comprises a backup roller and said applicator element comprises an applying roller, and said control means moves said applying roller to its splice position so that tape when provided within said staging means will contact tape when provided along said tape guide path between said applying roller and said backup roller, wherein said control means moves said applying roller back to its staging position after a predetermined length of tape is demanded from said continuous tape supply apparatus, and wherein said control means includes a means for counting revolutions of said backup roller after a splice has been initiated for determining that a predetermined length of tape has been demanded and moving said applying roller back to its staging position.

2. The continuous tape supply apparatus of claim 1, wherein said guide means for providing a tape guide path further includes a tension roller movably disposed on said support between first and second positions and operably positioned along said tape guide path upstream from said backup roller.

3. The continuous tape supply apparatus of claim 2, further including a cutting means provided adjacent to said tape guide path between said tension roller and said backup roller so that when said tension roller is in its first position, tape within the tape guide path will avoid said cutting means, and when said tension roller is moved to its second position, tape within the tape guide path will be cut by said cutting means.

4. The continuous tape supply apparatus of claim 3, wherein said control means further includes a means for moving said tension roller from its first position to its second position after said applying roller is moved from its staging position to its splicing position.

5. The continuous tape supply apparatus of claim 4, wherein said means for moving said tension roller comprises a sensor means for reading the position of said applying roller and for causing said tension roller to move from its first position to its second position.

6. The continuous tape supply apparatus of claim 1, wherein said control means further includes a splice control sensor for determining the occurrence of the determined event and for moving the applicator element from its staging position to its splice position.

7. The continuous tape supply apparatus of claim 6, wherein said splice control sensor senses the passing of a predetermined feature to be provided on tape along said tape guide path and provides a signal to said control means of such occurrence.

8. The continuous tape supply apparatus of claim 1, wherein said applying roller is movably disposed to said support by a pivoted arm so as to move from its staging position to its splice position, and so that a leading edge of tape when provided within said staging means will move from a position where it is extended beyond said applying roller to a position on said applying roller when said applying roller is moved from its staging position to its splice position.

9. The continuous tape supply apparatus of claim 1, wherein said splicing means further includes a tension control means for providing the tape from the continuous tape supply apparatus to the tape applicator machine at a substantially even tension.

10. The continuous tape supply apparatus of claim 9, wherein said tension control means includes a drive motor for driving tape along said tape guide path as controlled by a dancer arm mechanism also provided along said tape guide path.

11. A continuous tape supply apparatus for supplying adhesive tape to a tape applicator machine, said continuous tape supply apparatus comprising:

a) a support;

b) a first tape source station provided on said support for receiving a first tape supply source and from which adhesive tape of the first tape supply source can be dispensed;

c) a second tape source station provided on said support for receiving a second tape supply source and from which adhesive tape of the second tape supply source can be dispensed;

d) a splicing means provided on said support for splicing tape from said second tape source station to tape from said first tape source station using a lap splice without requiring any separate splicing tape and while continuing to supply adhesive tape to the tape applicator machine without stopping the supply of adhesive tape, so as to change the supply of tape from the first tape supply source to the second tape supply source, said splicing means comprising guide means for defining a tape guide path through said splicing means to be supplied from the continuous tape supply apparatus to the tape applicator machine, a staging means comprising an applicator element which is movably disposed on said support between a staging position with said applicator element spaced from said tape guide path and a splice position with said applicator element moved toward said tape guide path, and control means for causing the applicator element to move from its staging position to its splice position upon the occurrence of a determined event and for moving the applicator element from its splice position back to its staging position after a predetermined length of tape is demanded from said continuous tape supply apparatus, wherein said guide means for providing a tape guide path comprises a backup roller and said applicator element comprises an applying roller, and said control means moves said applying roller to its splice position so that tape when provided within said staging means will contact tape when provided along said tape guide path between said applying roller and said backup roller, wherein said control means includes a means for counting revolutions of said backup roller after a splice has been initiated for determining that a predetermined length of tape has been demanded and moving said applying roller back to its staging position.

12. The continuous tape supply apparatus of claim 11, wherein said control means moves said applying roller to its splice position wherein said applicator element is moved within said tape guide path to change said tape guide path.

13. The continuous tape supply apparatus of claim 12, wherein said guide means for providing a tape guide path further includes a tension roller movably disposed on said support between first and second positions and operably positioned along said tape guide path upstream from said backup roller.

14. The continuous tape supply apparatus of claim 13, further including a cutting means provided adjacent to said tape guide path between said tension roller and said backup roller so that when said tension roller is in its first position, tape within the tape guide path will avoid said cutting means, and when said tension roller is moved to its second position, tape within the tape guide path will be cut by said cutting means.

15. The continuous tape supply apparatus of claim 14, wherein said control means further includes a means for moving said tension roller from its first position to its second position after said applying roller is moved from its staging position to its splicing position.

16. The continuous tape supply apparatus of claim 15, wherein said means for moving said tension roller comprises a sensor means for reading the position of said applying roller and for causing said tension roller to move from its first position to its second position.

17. The continuous tape supply apparatus of claim 16, wherein said control means further includes a splice control sensor for determining the occurrence of the determined event and for moving the applicator element from its staging position to its splice position.

18. The continuous tape supply apparatus of claim 17, wherein said splice control sensor senses the passing of a predetermined feature to be provided on tape along said tape guide path and provides a signal to said control means of such occurrence.

19. The continuous tape supply apparatus of claim 11, wherein said applying roller is movably disposed to said support by a pivoted arm so as to move from its staging position to its splice position, and so that a leading edge of tape when provided within said staging means will move from a position where it is extended beyond said applying roller to a position on said applying roller when said applying roller is moved from its staging position to its splice position.

20. The continuous tape supply apparatus of claim 11, wherein said splicing means further includes a tension control means for providing the tape from the continuous tape supply apparatus to the tape applicator machine at a substantially even tension.

21. The continuous tape supply apparatus of claim 20, wherein said tension control means includes a drive motor for driving tape along said tape guide path as controlled by a dancer arm mechanism also provided along said tape guide path.

22. A tape applicator machine having an indexing demand cycle for tape and a continuous tape supply apparatus for supplying adhesive tape to said tape applicator machine, said continuous tape supply apparatus comprising:

a) a support;

b) a first tape source station provided on said support for receiving a first tape supply source and from which adhesive tape of the first tape supply source can be dispensed;

c) a second tape source station provided on said support for receiving a second tape supply source and from which adhesive tape of the second tape supply source can be dispensed;

d) a splicing means provided on said support for splicing tape from said second tape source station to tape from said first tape source station using a lap splice without requiring any separate splicing tape and while continuing to supply adhesive tape to the tape applicator machine without stopping the supply of adhesive tape, so as to change the supply of tape from the first tape supply source to the second tape supply source, said splicing means comprising guide means for defining a tape guide path through said splicing means to be supplied from the continuous tape supply apparatus to the tape applicator machine, a staging means comprising an applicator element which is movably disposed on said support between a staging position with said applicator element spaced from said tape guide path and a splice position with said applicator element moved within said tape guide path to change said tape guide path, and control means for causing the applicator element to move from its staging position to its splice position upon the occurrence of a determined event and for moving the applicator element from its splice position back to its staging position, wherein said guide means for providing a tape guide path comprises a backup roller and said applicator element comprises an applying roller, and said control means moves said applying roller to its splice position so that tape when provided within said staging means will contact tape when provided along said tape guide path between said applying roller and said backup roller, wherein said control means moves said applying roller back to its staging position after a predetermined length of tape is demanded from said continuous tape supply apparatus, and wherein said control means includes a means for counting revolutions of said backup roller after a splice has been inititiated for determining that a predetermined length of tape has been demanded and moving said applying roller back to its staging position.

23. The tape applicator machine and continuous tape supply apparatus of claim 22, wherein said guide means for providing a tape guide path further includes a tension roller movably disposed on said support between first and second positions and operably positioned along said tape guide path upstream from said backup roller.

24. The tape applicator machine and continuous tape supply apparatus of claim 23, further including a cutting means provided adjacent to said tape guide path between said tension roller and said backup roller so that when said tension roller is in its first position, tape within the tape guide path will avoid said cutting means, and when said tension roller is moved to its second position, tape within the tape guide path will be cut by said cutting means.

25. The tape applicator machine and continuous tape supply apparatus of claim 24, wherein said control means further includes a means for moving said tension roller from its first position to its second position after said applying roller is moved from its staging position to its splicing position.

26. The tape applicator machine and continuous tape supply apparatus of claim 25, wherein said means for moving said tension roller comprises a sensor means for reading the position of said applying roller and for causing said tension roller to move from its first position to its second position.

27. The tape applicator machine and continuous tape supply apparatus of claim 22, wherein said control means further includes a splice control sensor for determining the occurrence of the determined event and for moving the applicator element from its staging position to its splice position.

28. The tape applicator machine and continuous tape supply apparatus of claim 27, wherein said splice control sensor senses the passing of a predetermined feature to be provided on tape along said tape guide path and provides a signal to said control means of such occurrence.

29. The tape applicator machine and continuous tape supply apparatus of claim 22, wherein said applying roller is movably disposed to said support by a pivoted arm so as to move from its staging position to its splice position, and so that a leading edge of tape when provided within said staging means will move from a position where it is extended beyond said applying roller to a position on said applying roller when said applying roller is moved from its staging position to its splice position.

30. The tape applicator machine and continuous tape supply apparatus of claim 22, wherein said splicing means further includes a tension control means for providing the tape from the continuous tape supply apparatus to the tape applicator machine at a substantially even tension.

31. The tape applicator machine and continuous tape supply apparatus of claim 30, wherein said tension control means includes a drive motor for driving tape along said tape guide path as controlled by a dancer arm mechanism also provided along said tape guide path.

* * * * *

UNITED STATES PATENT AND TRADEMARK OFFICE

CERTIFICATE OF CORRECTION

PATENT NO.: 5,624,526

DATED: April 29, 1997

INVENTOR(S): Jack L. Perecman, Lloyd S. Vasilakes, Daniel D. Baker, Van E. Jensen, Jr.

It is certified that error appears in the above-identified patent and that said Letters Patent is hereby corrected as shown below:

Col. 21, Line 47, "staring" should be -- staging --.

Signed and Sealed this

Eighteenth Day of May, 1999

*Attest:*

*Attesting Officer*

Q. TODD DICKINSON

*Acting Commissioner of Patents and Trademarks*